US011279573B2

(12) United States Patent
Ohtsuka

(10) Patent No.: US 11,279,573 B2
(45) Date of Patent: Mar. 22, 2022

(54) SHEET HOLDER, SHEET FEEDING DEVICE INCORPORATING THE SHEET HOLDER, AND IMAGE FORMING APPARATUS INCORPORATING THE SHEET HOLDER

(71) Applicant: Rie Ohtsuka, Tokyo (JP)

(72) Inventor: Rie Ohtsuka, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 372 days.

(21) Appl. No.: 16/430,738

(22) Filed: Jun. 4, 2019

(65) Prior Publication Data

US 2020/0017321 A1 Jan. 16, 2020

(30) Foreign Application Priority Data

Jul. 13, 2018 (JP) ..... JP2018-133534
Oct. 19, 2018 (JP) ..... JP2018-197588

(51) Int. Cl.
*B65H 1/04* (2006.01)
*G03G 15/00* (2006.01)

(52) U.S. Cl.
CPC ..... *B65H 1/04* (2013.01); *G03G 15/6529* (2013.01); *B65H 2511/12* (2013.01)

(58) Field of Classification Search
CPC ..... B65H 2511/12; B65H 2511/11; B65H 2403/411; B65H 1/04; B65H 1/266; B65H 2553/21; G03G 15/6529
See application file for complete search history.

(56) References Cited

U.S. PATENT DOCUMENTS 6,070,048 A * 5/2000 Nonaka ..... B65H 1/00 399/376
2015/0183610 A1 7/2015 Matsuki et al.
(Continued)

FOREIGN PATENT DOCUMENTS

CN 102336341 A 2/2012
CN 10443399 9/2015
CN 104909187 A 9/2015
(Continued)

OTHER PUBLICATIONS

Chinese Office Action dated Sep. 3, 2020.

*Primary Examiner* — Luis A Gonzalez
(74) *Attorney, Agent, or Firm* — Harness, Dickey & Pierce, P.L.C.

(57) ABSTRACT

A sheet holder includes a regulator, a rotary body, a detection target, a rotational position detector, and a biasing body. The regulator moves in directions to approach and separate from an end portion of a sheet. The rotary body has a contact portion and rotates according to movement of the regulator. The detection target is attached to the rotary body, has a contact target portion, and rotates together with the rotary body by contacting of the contact portion of the rotary body with the contact target portion of the detection target in a rotational direction of the rotary body. The rotational position detector detects a rotational position of the detection target. The biasing body applies a biasing force between the rotary body and the detection target to maintain a contact state of the contact portion of the rotary body and the contact target portion of the detection target.

19 Claims, 16 Drawing Sheets

(56) References Cited

U.S. PATENT DOCUMENTS

| | | | | |
|---|---|---|---|---|
| 2016/0122142 | A1* | 5/2016 | Okada | B65H 1/00 271/110 |
| 2017/0001816 | A1 | 1/2017 | Ichikawa | |

FOREIGN PATENT DOCUMENTS

| | | | |
|---|---|---|---|
| CN | 106315265 | A | 1/2017 |
| JP | H11-199088 | A | 7/1999 |
| JP | 2002-039712 | | 2/2002 |
| JP | 2014-005145 | | 1/2014 |
| JP | 2015-113198 | | 6/2015 |

* cited by examiner

SHEET HOLDER, SHEET FEEDING DEVICE INCORPORATING THE SHEET HOLDER, AND IMAGE FORMING APPARATUS INCORPORATING THE SHEET HOLDER

CROSS-REFERENCE TO RELATED APPLICATIONS

This patent application is based on and claims priority pursuant to 35 U.S.C. § 119(a) to Japanese Patent Application Nos. 2018-133534, filed on Jul. 13, 2018, and 2018-197588, filed on Oct. 19, 2018, in the Japan Patent Office, the entire disclosure of each of which is hereby incorporated by reference herein.

BACKGROUND

Technical Field

This disclosure relates to a sheet holder, a sheet feeding device incorporating the sheet holder, and an image forming apparatus incorporating the sheet holder.

Related Art

Various types of sheet holders are known to include a regulating member that moves in a contact and separation direction relative to the end portion of a sheet, a rotating member that rotates according to movement of the regulating member, a detection target member that is attached to the rotating member and rotates together with the rotating member, and a rotation position detecting unit that detects the rotation position of the detection target member.

For example, a known document tray that functions as a sheet holder includes a centering mechanism that matches the center in the width direction of an original document to the center in the width direction of a fixed tray constantly even when the size of an original document changes.

The centering mechanism includes a pinion and a pair of racks. The pair of racks is provided on both sides of the pinion and is meshed with the pinion, so as to be guided in a direction passing each other (in other words, in the width direction of an original document). Each rack of the pair of racks is provided with an aligning plate that is movable in a contact and separation direction to the end in the width direction of an original document. One rack of the pair of racks is meshed with a gear that is attached to the input shaft of a rotary sensor. As a user moves while grabbing the corresponding aligning plate, the pair of racks move. In response to this action, the gear is rotated, so that the amount of rotations of the gear is detected by the rotary sensor. The detection result of the rotary sensor (i.e., the amount of rotations of the input shaft) is used to determine the size in the width direction of an original document.

SUMMARY

At least one aspect of this disclosure provides a sheet holder including a regulator, a rotary body, a detection target, a rotational position detector, and a biasing body. The regulator moves to move in directions to approach an end portion of a sheet and separates from the end portion of the sheet. The rotary body has a contact portion and rotates according to movement of the regulator. The detection target is attached to the rotary body, has a contact target portion and rotates together with the rotary body by contacting of the contact portion of the rotary body with the contact target portion of the detection target in a rotational direction of the rotary body. The rotational position detector detects to detect a rotational position of the detection target. The biasing body applies a biasing force between the rotary body and the detection target to maintain a contact state of the contact portion of the rotary body and the contact target portion of the detection target.

Further, at least one aspect of this disclosure provides a sheet feeding device including the above-described sheet holder to hold a sheet to be fed by the sheet feeding device.

Further, at least one aspect of this disclosure provides an image forming apparatus including the above-described sheet holder.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
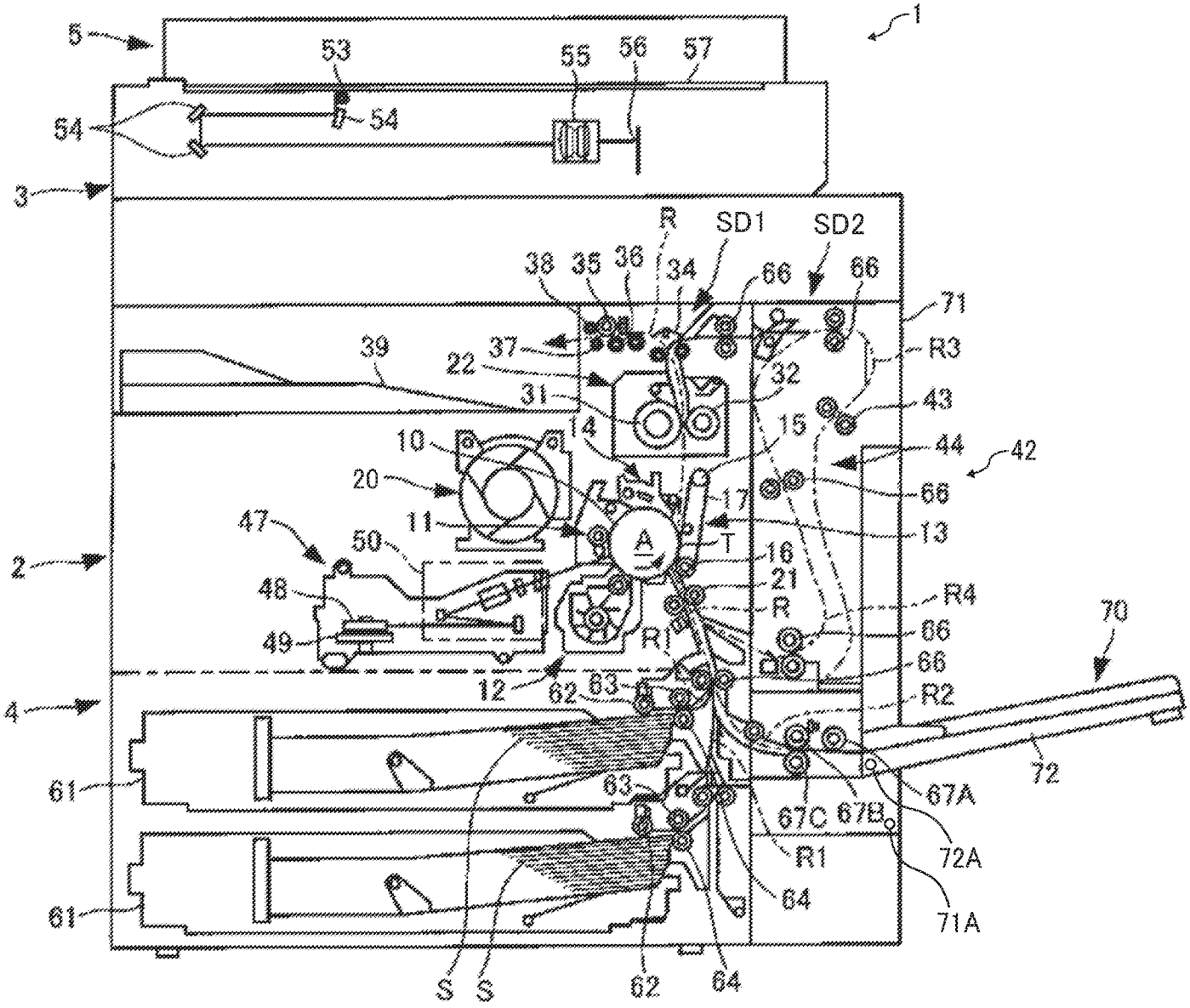
FIG. 1 is a schematic diagram illustrating an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above". "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an example applicable to a sheet holder, a sheet feeding device incorporating the sheet holder, and an image forming apparatus incorporating the sheet holder.

It is to be noted that elements (for example, mechanical parts and components) having the same functions and shapes are denoted by the same reference numerals throughout the specification and redundant descriptions are omitted.

Here, a description is given of a sheet holder according to an embodiment of this disclosure, applied to a bypass tray of an image forming apparatus.

FIG. 1 is a diagram illustrating a configuration of an image forming apparatus 1 according to an embodiment of this disclosure.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an electrophotographic printer that prints toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

The image forming apparatus 1 corresponds to a copier in the present embodiment of this disclosure and includes an apparatus body 2, an image reading device 3, a sheet feeding device 4, and an automatic document feeder 5. The image reading device 3 is disposed on apparatus body 2 of the image forming apparatus 1. The sheet feeding device 4 having a table-like shape is disposed below the apparatus body 2 of the image forming apparatus 1. The automatic document feeder 5 is disposed on the image reading device 3 to be openable and closable.

The image forming apparatus 1 further includes a switchback device 42 and a bypass sheet feeding device 70.

The apparatus body 2 includes a drum-shaped photoconductor 10 that functions as an image bearer.

Various image forming units are disposed around the photoconductor 10. Specifically, a charging device 11 is disposed on the left side of the drawing sheet, and a developing device 12, a transfer device 13, and a cleaning device 14 are disposed in this order in a rotational direction of the photoconductor 10 (in other words, a counterclockwise direction indicated by arrow A in FIG. 1).

The transfer device 13 includes an upper roller 15, a lower roller 16, and a transfer belt 17 that is wound around the upper roller 15 and the lower roller 16. The transfer belt 17 is pressed against a circumferential surface of the photoconductor 10 at a transfer position T.

A toner supplying device 20 is disposed on the left side of the charging device 11 and the cleaning device 14. The toner supplying device 20 supplies new toner to the developing device 12.

Further, a sheet conveying device SD1 is disposed inside the apparatus body 2 of the image forming apparatus 1. The sheet conveying device SD1 feeds sheets such as papers and overhead projector (OHP) sheets, from a sheet supplying position that is described below, and conveys the sheets to a sheet stacking position via the transfer position T. The sheet conveying device SD1 includes a supply path R1, a manual feed path R2, and a sheet conveyance path R, which will be described below. The conveyance passage R has a substantially L shape extending between the photoconductor 10 and the transfer device 13 and extending upward from the bottom and then bending left in the drawing.

A pair of registration rollers 21 is disposed upstream from the photoconductor 10 in the sheet conveying direction.

Further, a fixing device 22 is disposed downstream from the photoconductor 10 in the sheet conveying direction. The fixing device 22 includes a pair of fixing rollers (fixing roller rotating bodies) 31 and 32. A fixing heater is disposed inside the fixing roller 31. A pressure spring and a pressure arm are disposed around the fixing roller 32. The pressure spring and the pressure arm cause the fixing roller 32 to press the fixing roller 31. Further, a thermistor and a thermostat are disposed to the fixing roller 31.

The fixing heater uses the thermistor to measure the temperature of the fixing roller 31, and uses the thermostat to turn on or off the fixing heater to keep the fixing rollers 31 at a predetermined temperature.

A sheet ejection separating claw 34, a pair of sheet discharging rollers 35, a first pressure roller 36, a second pressure roller 37, and a stiffening roller 38 are disposed downstream from the fixing device 22. An ejected sheet stacking portion 39 (i.e., a sheet ejecting position) is disposed further downstream from the stiffening roller 38 to stack sheets having images.

A laser writing device 47 is disposed on the left side of the developing device 12 in FIG. 1. The laser writing device 47 includes a laser light source, a rotary polygon mirror 48 for scanning, a polygon motor 49, and a scanning optical system 50 such as an f-theta lens.

The image reading device 3 includes a light source 53, a plurality of mirrors 54, an imaging optical lens 55, and an image sensor 56 such as a CCD (charge coupled device). An exposure glass 57 is disposed on the image reading device 3.

One end portion of the automatic document feeder 5 is coupled to one end of the upper face of the image reading device 3 by a connecting tool having a hinge structure. The automatic document feeder 5 is openable and closable to open from a horizontal state in which the lower face of the automatic document feeder 5 presses onto an original document placed on the top face of the exposure glass 57, to a state in which the automatic document feeder 5 opens up to the angle of 90 degrees to the top face of the exposure glass 57. The automatic document feeder 5 has a loading table at the document loading position of the original document, an ejecting table at the ejecting position of the original document, and a sheet conveying device having a document conveying passage through which a sheet such as an original document is conveyed from the loading table to the ejecting table via the reading position on the exposure glass 57 of the image reading device 3. The sheet conveying device includes a plurality of sheet conveying rollers (in other words, a sheet conveyance rotary bodies) to convey a sheet conveying a sheet such as a document.

The sheet feeding device 4 includes sheet separating devices 61 in multiple stages. Each sheet separating device 61 functions as a separating device internally includes a sheet separation device 61 that is located at a sheet feeding position of the sheet S in multiple stages.

Each sheet separation device 61 includes a sheet pickup roller 62 (that functions as a feed roller), a sheet feed roller 63 (that functions as a feed roller), and a sheet reverse roller 64 (that functions as a separation roller).

A sheet supplying passage R1 is defined on the right side of the sheet separating devices 61 of multiple stages in FIG. 1. The sheet supplying passage R1 extends to the sheet conveyance passage R of the apparatus body 2 of the image forming apparatus 1. The sheet supplying passage R1 includes sheet conveying rollers 66 (each of which functions as a sheet conveyance rotary body) to convey a sheet.

The switchback device 42 is disposed on the right side of the apparatus body 2 of the image forming apparatus 1 in FIG. 1. The switchback device 42 includes a sheet conveying device SD2 that branches or separates from a position of the sheet ejection separating claw 34 in the sheet conveyance passage R.

The sheet conveying device SD2 includes a sheet reverse passage R3 and a reentry sheet conveyance passage R4. The sheet reverse passage R3 extends to guide a sheet to a switchback position 44 at which a pair of switchback rollers 43 is disposed. The reentry sheet conveyance passage R4 extends to guide the sheet form the switchback position 44 to the pair of registration rollers 21 in the sheet conveyance passage R. The sheet conveying device SD2 includes the sheet conveying rollers 66 (each of which functions as a sheet conveyance rotary body) to convey the sheet. In the present embodiment, the switchback device 42 is attached to an opening closing member 71.

The bypass sheet feeding device 70 is disposed on the right side of the apparatus body 2 of the image forming apparatus 1 in FIG. 1. The bypass sheet feeding device 70 includes a sheet pickup roller 67A (that functions as a feed roller), a sheet feed roller 67B (that functions as a feed roller), and a sheet reverse roller 67C (that functions as a feed roller) and supplies a sheet S placed on a bypass tray 72 to the sheet conveyance passage R of the apparatus body 2 of the image forming apparatus 1.

Next, a description is given of operations performed by the image forming apparatus 1.

First, in order to generate a copy using the image forming apparatus 1, the main switch of the image forming apparatus 1 is turned on and an original document is set on the automatic document feeder 5.

Alternatively, the automatic document feeder 5 is opened to set the original document directly on the exposure glass 57 of the image reading device 3, and then then is closed to press and hold the original document.

In a case in which the original document is set on the automatic document feeder 5, as the start switch of the image forming apparatus 1 is pressed, the original document is conveyed by a sheet conveying roller or sheet conveying rollers via a document conveyance passage onto the exposure glass 57. Then, the image reading device 3 is started to read data of the original document before the original document is ejected to the ejecting table. By contrast, in a case in which the original document is placed directly on the exposure glass 57, the image reading device 3 is started immediately.

As the image reading device 3 is started, the light source 53 moves along the exposure glass 57 while emitting light, so that the light is emitted onto the surface of the original document placed on the exposure glass 57.

The plurality of mirrors 54 receive reflected light from the surface of the original document and reflect the light toward the imaging optical lens 55. The imaging optical lens 55 focuses this reflected light on the image sensor 56. By so doing, the image sensor 56 reads the data of the original document.

At the same time, the photoconductor 10 is rotated by at the same time, the photoconductor 10 is rotated by a photoconductor drive motor, along which the surface of the photoconductor 10 is uniformly charged by the charging device 11 with a charging roller. Then, the laser writing device 47 emits light onto the surface of the photoconductor 10 according to the data of the original document read by the image reading device 3. By so doing, the data is written onto the surface of the photoconductor 10, so that an electrostatic latent image is formed on the surface of the photoconductor 10. Thereafter, as the electrostatic latent image formed on the surface of the photoconductor 10 comes to face the developing device 12, toner adheres to the surface of the photoconductor 10, so that the electrostatic latent image is visualized.

Further, when the start switch is pressed, one of the sheet separating devices 61 of multiple stages is selected based on a selection signal of the size of a sheet. Then, the sheet pickup roller 62 that corresponds to the sheet separating device 61 feeds one sheet S in the sheet separating device 61. When multiple sheets S are about to be fed, the sheet reverse roller 64 separates an uppermost sheet S to restrain or prevent conveyance of the other sheets S. Subsequently, the sheet feed roller 63 causes the (uppermost) sheet S to be fed to the sheet supplying passage R1 while conveying the (uppermost) sheet S. Then, the sheet conveying rollers 66 conveys the sheet S to the sheet conveyance passage R. When the sheet S contacts the pair of registration rollers 21, where conveyance of the sheet S is stopped. Then, the pair of registration rollers 21 rotates in synchronization with rotations of the photoconductor 10, so that the sheet S is conveyed to the right side of the photoconductor 10 in FIG. 1.

When the bypass sheet feeding is performed, the bypass tray 72 of the bypass sheet feeding device 70 is moved from a closed state in which the bypass tray 72 stands upright, to an open state in which the bypass tray 72 opens at the angle as illustrated in FIG. 1. With this open state, the sheet S is set on a sheet loading face 72B of the bypass tray 72.

When the start switch is pressed, the sheet pickup roller 67A conveys one sheet and the sheet feed roller 67B receives the sheet S to take over and continue conveyance of the sheet S. When multiple sheets S are about to be fed, the sheet reverse roller 67C separates an uppermost sheet S to restrain or prevent conveyance of the other sheets S.

The sheet conveying roller 66 continues to convey the sheet S supplied to the bypass sheet supplying passage R2 to guide the sheet S to the sheet conveyance passage R.

Thereafter, similar to the operations of the sheet feeding device 4 described above, the pair of registration rollers 21 conveys the sheet S to the right side of the photoconductor 10 in synchronization with rotations of the photoconductor 10, so that the sheet S is conveyed to the right side of the photoconductor 10 in FIG. 1.

Then, when the sheet S that is conveyed to the right side of the photoconductor 10 in FIG. 1 comes to the transfer position T, the transfer device 13 transfers the toner image on the photoconductor 10 to form an image on the sheet S. The cleaning device 14 removes and cleans the residual toner remaining on the surface of the photoconductor 10 after transfer of the image. Then, the static eliminator removes the residual potential on the surface of the photoconductor 10, so as to prepare next image formation that starts from the charging device 11.

Next, the fixing device 22 conveys the sheet S, on which the toner image is transferred, by the transfer belt 17 through the pair of fixing rollers 31 and 32, and fixes the transfer image by application of heat and pressure at the fixing position. Thereafter, the sheet S to which the transfer image is fixed is flatted and stiffened while passing the first pressure roller 36, the second pressure roller 37, the second pressure roller 37, and the stiffening roller 38. Then, the sheet S is ejected to the ejected sheet stacking portion 39 to be stacked.

It is to be noted that the sheet ejection separating claw 34 is switched when image is transferred onto both sides of the sheet S. Then, the sheet S having an image having been transferred onto the front face is conveyed from the sheet conveyance passage R to the sheet reverse passage R3. The sheet S is then conveyed to the switchback position 44 by the sheet conveying rollers 66, and then switches back at the switchback position 44. Thereafter, the sheet S is conveyed to the reentry sheet conveyance passage R4 to be reversed. The sheet S is then conveyed by the sheet conveying rollers 66 to the sheet conveyance passage R again. Then, as described above, an image is transferred onto the back face of the sheet S.

Figure 2:
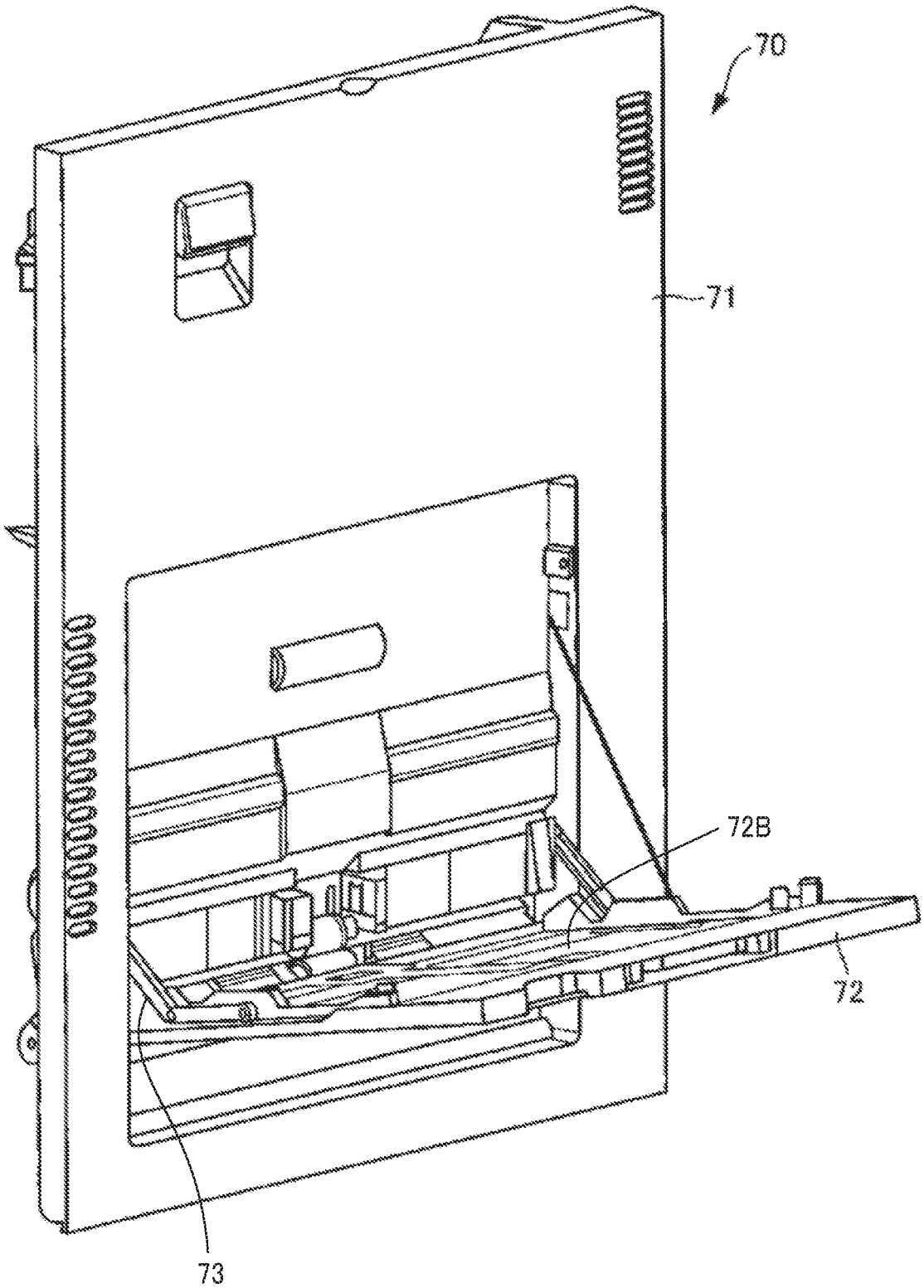
FIG. 2 is an external perspective view illustrating a bypass sheet feeding device of the image forming apparatus of FIG. 1.

FIG. 2 is an external perspective view illustrating the bypass sheet feeding device 70.

As illustrated in FIG. 1, the bypass sheet feeding device 70 according to the present embodiment of this disclosure includes the opening closing member 71 and the bypass tray 72. The opening closing member 71 has a rotational support 71A, so that the upper part of the opening closing member 71 opens and closes about the rotational support 71A at the lower part of the opening closing member 71, relative to the apparatus body 2 of the image forming apparatus 1. The bypass tray 72 has a rotational support 72A, so that the upper part of the bypass tray 72 opens and closes about the rotational support 72A at the lower part of the bypass tray 72, relative to the opening closing member 71. Further, as illustrated in FIG. 2, the bypass sheet feeding device 70 includes a link member 73 that couples the opening closing member 71 to be openable and closable to the apparatus body 2 of the image forming apparatus 1.

In order to easily remove a sheet or sheets jammed in the sheet conveyance passage R and the reentry sheet conveyance passage R4 and maintain the inside of the apparatus body 2 of the image forming apparatus 1, the opening closing member 71 is moved to open at an inclined position in the open state to open the sheet conveyance passage R and the reentry sheet conveyance passage R4. In other words, by changing the opening closing member 71 from the upright position in the closed state to the inclined position in the open state, the bypass sheet feeding device 70 exposes the sheet conveyance passage R and the reentry sheet conveyance passage R4 so as to enable removal of a jammed sheet (or jammed sheets) and maintenance of the device easily.

In addition, the bypass sheet feeding device 70 sets the bypass tray 72 to change from the upright position in the closed state to the inclined position in the open state (see FIG. 1), so that a sheet (or sheets) is loaded on the sheet loading face 72B of the bypass tray 72. By so doing, a sheet for the bypass feeding is supplied to the sheet conveyance passage R.

Figure 3:
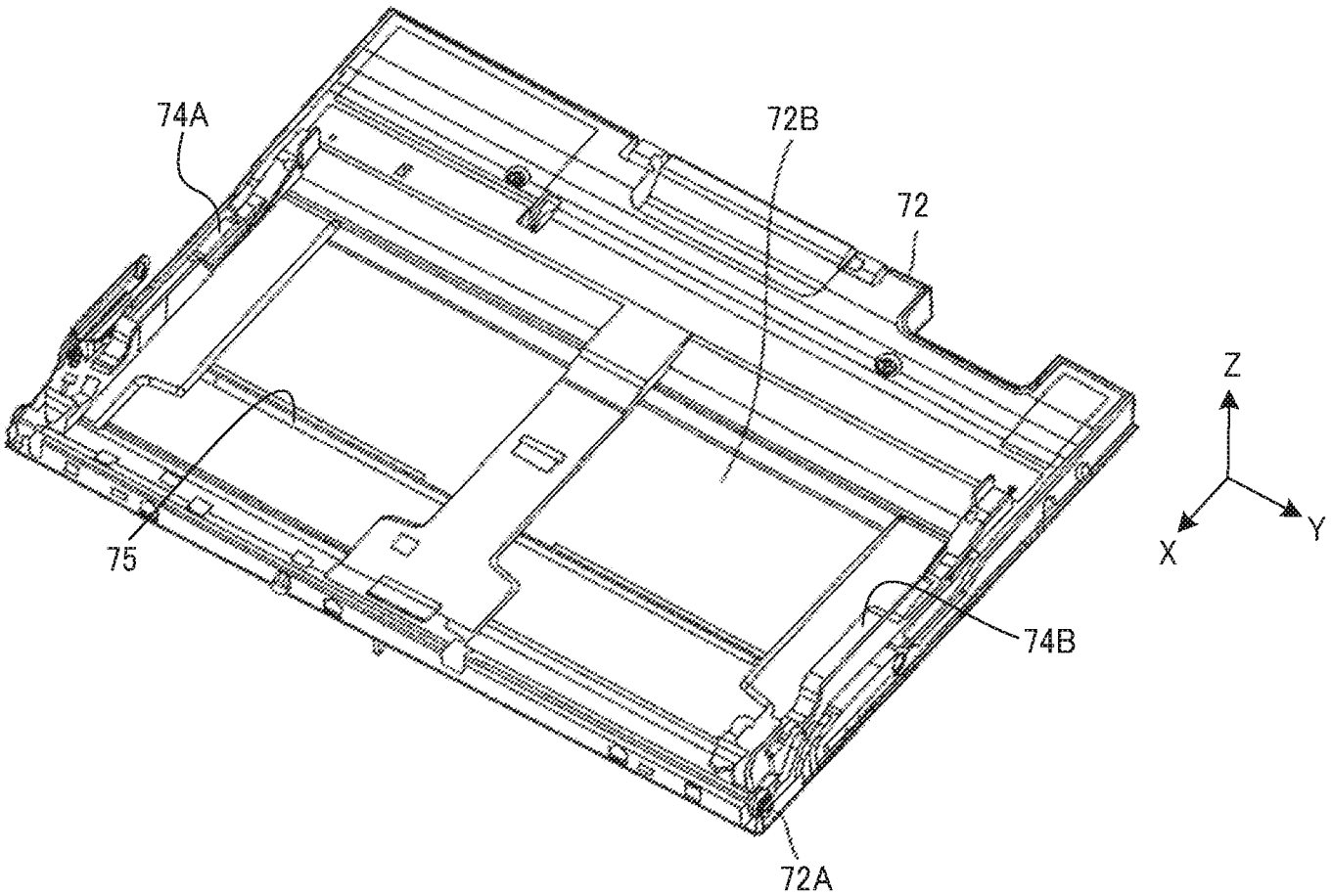
FIG. 3 is a perspective view illustrating a bypass tray according to an embodiment of this disclosure.

FIG. 3 is a perspective view illustrating the bypass tray 72 according to the present embodiment of this disclosure.

As illustrated in FIG. 3, the bypass tray 72 that functions as a sheet holder includes side fences 74A and 74B and a guide rail 75. The side fences 74A and 74B are installed in a sheet width direction (i.e., in a Y-axis direction) in upper space above the sheet loading face 72B (in other words, loading space of the sheet S).

The bypass tray 72 according to the present embodiment includes the guide rail 75 that functions as a guide, extending along the sheet width direction (the Y-axis direction).

The side fences 74A and 74B are installed in a pair at both ends in the sheet width direction so as to sandwich the sheet S. The side fences 74A and 74B are manually movable in a direction to approach and separate with respect to the end portion in the sheet width direction of the sheet S, and are positioned along the size in the sheet width direction of the sheet S. That is, each of the side fences 74A and 74B functions as a regulator that regulates the position of the sheet S in the sheet width direction.

In the bypass tray 72 according to the present embodiment, an end fence may be disposed on the upstream side of the sheet conveying direction (i.e., an X-axis direction) in the upper space above the sheet loading face 72B (i.e., sheet loading space of the sheet S). To be more specific, for example, a guide rail that functions as a guide is provided to the bypass tray 72, extending in the sheet conveying direction (i.e., the X-axis direction) and the end fence is movably disposed in the sheet conveying direction along the guide rail. The end fence is positioned in accordance with the size in the sheet conveying direction of the sheet S placed on the sheet loading face 72B. That is, the end fence functions as a regulating member that regulates the end position of the sheet S in the sheet conveying direction. A Z-direction in FIG. 3 corresponds to a vertical direction that extends upward (i.e., a positive Z-axis direction) and downward (i.e., a negative Z-axis direction).

In the present embodiment, the side fences 74A and 74B in pair are configured to operate simultaneously with each other to increase or decrease the intervals in the sheet width direction. That is, when one of the side fences 74A and 74B is moved manually in the positive Y-axis direction, the other one of the side fences 74A and 74B is moved in the negative Y-axis direction simultaneously with movement of the one of the side fences 74A and 74B. Similarly, when one of the side fences 74A and 74B is moved manually in the negative Y-axis direction, the other one of the side fences 74A and 74B is moved in the positive Y-axis direction simultaneously with movement of the one of the side fences 74A and 74B.

It is to be noted that, in FIG. 3, the sheet conveying direction of the sheet S corresponds to the X-axis direction and the bypass tray 72 is inserted and removed in the Y-axis direction, but this disclosure is not limited to the above-described relation of directions.

Figure 4:
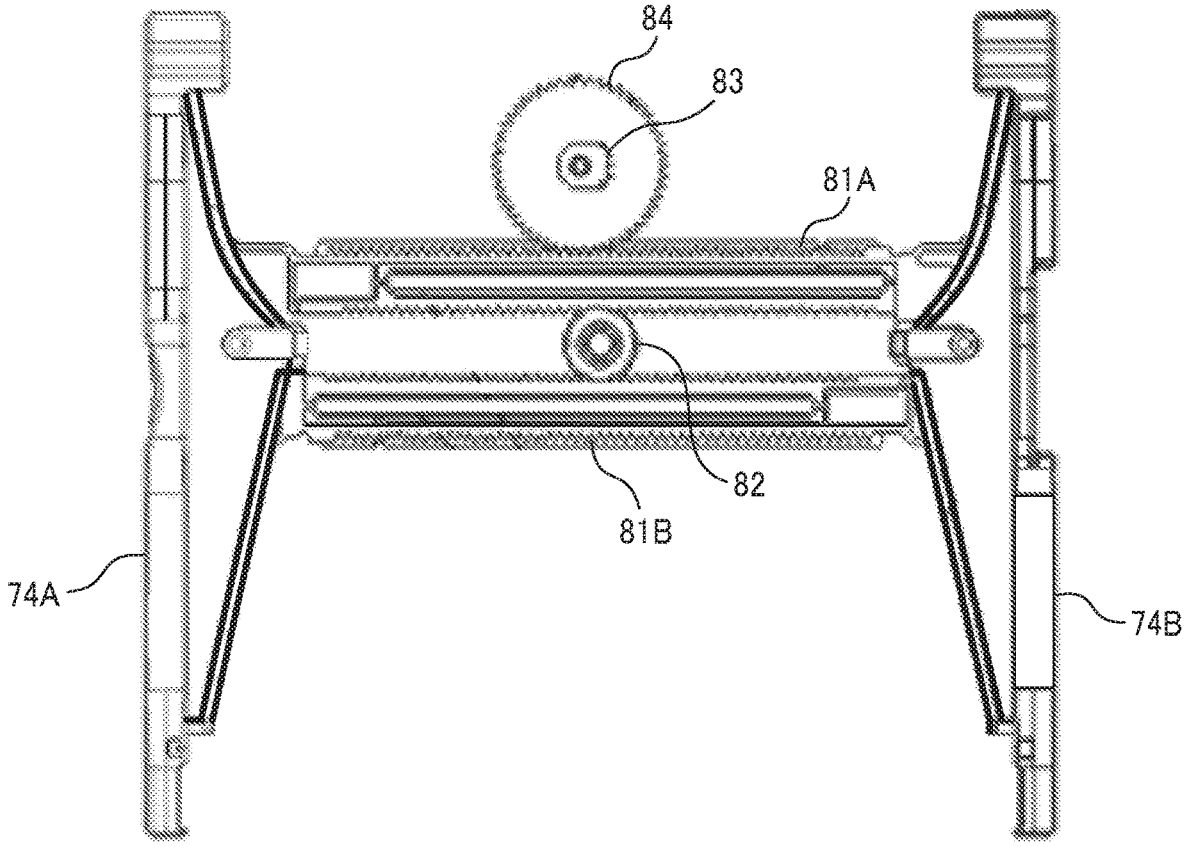
FIG. 4 is a plan view illustrating a moving mechanism of a side fence of the bypass tray.

FIG. 4 is a plan view illustrating the moving mechanism of the side fences 74A and 74B in the bypass tray 72 according to the present embodiment.

The moving mechanism of the side fences 74A and 74B in the present embodiment causes the side fences 74A and 74B in pair to move simultaneously so that the center in the width direction of the sheet S matches the center in the sheet width direction of the bottom plate 24 even if the size in the sheet width direction of the sheet S varies. In the present embodiment, a rack and pinion mechanism is used as a moving mechanism of the side fences 74A and 74B.

To be more specific, as illustrated in FIG. 4, racks 81A and 81B are provided to the side fences 74A and 74B, respectively. Each of the racks 81A and 81B is meshed with a pinion 82 so as to sandwich the pinion 82 that is disposed substantially at the center in the sheet width direction from both sides. Thus, when one of the side fences 74A and 74B is moved in the sheet width direction, the racks 81A and 81B of the side fences 74A and 74B interlock to move in the sheet width direction to rotate the pinion 82. According to rotations of the pinion 82, one of the racks 81A and 81B (for example, the rack 81B) is moved in a direction passing each other along the sheet width direction. Along with this movement of the rack 81B, the other one of the side fences 74B and 74A (for example, the side fence 74B) is moved in the sheet width direction.

In the present embodiment, a gear 84 (that functions as a rotary body) is meshed with the rack 81A. The rotary shaft 84*a* of the gear 84 is fitted to and engaged with an engagement hole 83*b* (that functions as an engaging opening) formed in a rotor 83*a* (that functions as a detection target) of a rotary sensor 83 (that functions as a rotational position detector), so that the gear 84 and the rotary sensor 83 are coupled to each other. When a user moves the side fence 74A, for example, in the sheet width direction, the rack 81A of the side fence 74A is moved in the sheet width direction simultaneously with the movement of the side fence 74A.

According to this movement, the gear 84 that is meshed with the rack 81A is rotated. Accordingly, the rotor 83*a* of the rotary sensor 83 that is coupled with the gear 84 rotates together with the gear 84, and therefore the amount of rotations of the rotor 83*a* is detected by the rotary sensor 83. The detection result of the rotary sensor 83 (i.e., the amount of rotations of the rotor 83*a*) is sent to the controller of the image forming apparatus 1 to be used, for example, to determine the size in the sheet width direction of the sheet S that is set on the bypass tray 72, for example.

Figure 5A:
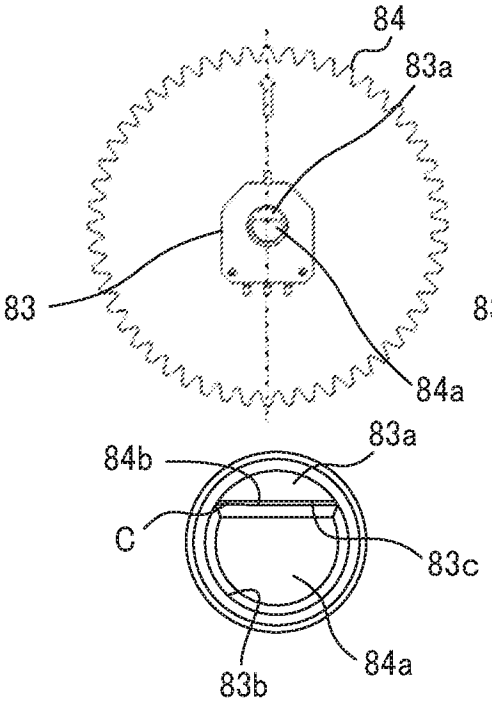
FIGS. 5A, 5B, and 5C are diagrams illustrating states in which a difference is generated between the detection result of a rotary sensor and the amount of rotation of a gear.
Figure 5B:
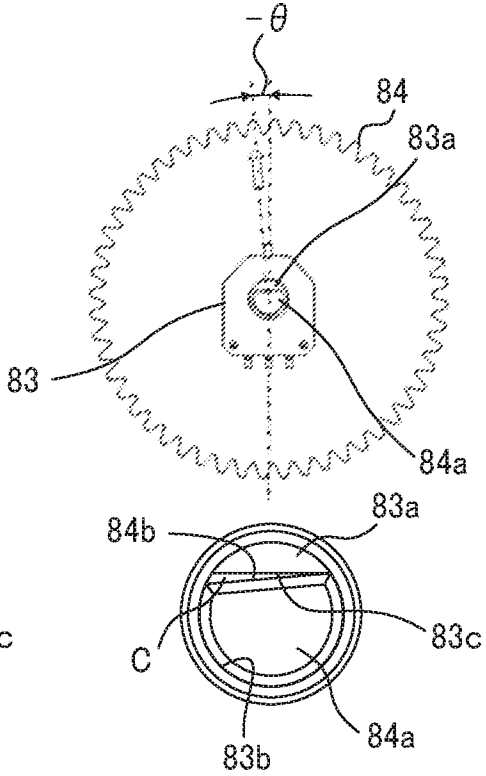
Figure 5C:
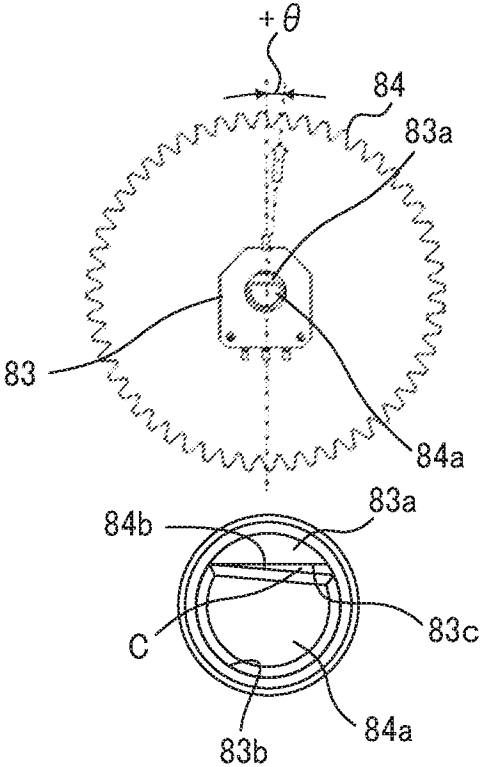

FIGS. 5A, 5B, and 5C are diagrams illustrating states in a case in which there is a difference between the detection result of the rotary sensor 83 (i.e., the amount of rotations of the rotor 83*a*) and the amount of rotations of the gear 84 (i.e., the respective positions of the side fences 74A and 74B).

For coupling of the rotor 83*a* of the rotary sensor 83 and the gear 84 in the present embodiment, the rotary shaft 84*a* of the gear 84 is formed to a D-shaped shaft and the engagement hole 83*b* of the rotor 83*a* is formed to a D-cut shape to be an inner wall flat portion 83*c* (in other words, an inner wall surface that functions as a contact target portion and an engaging surface) that corresponds to an engagement face to be engaged with the D-cut face 84*b* (i.e., a contact portion). Accordingly, the rotor 83*a* and the gear 84 rotate together.

The above-described connection structure, however, is likely to generate a gap C between the D-cut face 84*b* of the rotary shaft 84*a* and the inner wall flat portion 83*c* of the engagement hole 83*b*, as illustrated in FIG. 5A, due to dimensional variation of the engagement hole 83*b* having a D-cut shape and the rotary shaft 84*a* that is a D-shaped shaft to be fitted to the engagement hole 83*b*. With a gap such as the gap C, the contact state of the D-cut face 84*b* formed in the rotary shaft 84*a* of the gear 84 and the inner wall flat portion 83*c* of the engagement hole 83*b* of the rotor 83*a* is not uniquely determined.

To be more specific, in a case in which the side fences 74A and 74B are moved in opposite directions to increase the interval between the side fences 74A and 74B, the rotary shaft 84*a* of the gear 84 rotates in a counterclockwise direction, as illustrated in FIG. 5B, to rotate relative to the engagement hole 83*b* of the rotor 83*a* by the amount of the gap C. As a result, while one end side of the D-cut face 84*b* in a direction perpendicular to the axial direction of the rotary shaft 84*a* of the gear 84 (in other words, an end portion on the right side in the drawing) contacts one end side of the inner wall flat portion 83*c* of the engagement hole 83*b* of the rotor 83*a* (in other words, an end portion on the right side in the drawing), the other end side of the D-cut face 84*b* and the other end side of the inner wall flat portion 83*c* separate from each other. In the above-described state, when compared with a state in which the D-cut face 84*b* and the inner wall flat portion 83*c* are disposed parallel to each other, the gear 84 is located at a rotational position at which the gear 84 is relatively rotated to the rotor 83*a* by the angle of −θ°.

In addition, in a case in which the side fences 74A and 74B are moved in opposite directions to decrease the interval between the side fences 74A and 74B, the rotary shaft 84*a* of the gear 84 rotates in a clockwise direction, as illustrated in FIG. 5C, to rotate relative to the engagement hole 83*b* of the rotor 83*a* by the amount of the gap C. As a result, while the other end side of the D-cut face 84*b* in the direction perpendicular to the axial direction of the rotary shaft 84*a* of the gear 84 (in other words, an end portion on the left side in the drawing) contacts the other end side of the inner wall flat portion 83*c* of the engagement hole 83*b* of the rotor 83*a* (in other words, an end portion on the left side in the drawing), the one end side of the D-cut face 84*b* and the one end side of the inner wall flat portion 83*c* separate from each other. In the above-described state, when compared with a state in which the D-cut face 84*b* and the inner wall flat portion 83*c* are disposed parallel to each other, the gear 84 is located at a rotational position at which the gear 84 is relatively rotated to the rotor 83*a* by the angle of +0°.

As a result of the above-described configuration, even if the positions of the side fences 74A and 74B are not changed, it is likely that the angle detected by the rotary sensor 83 varies within the range of the angle of 2θ°. In particular, the angle of 2θ° at most is generated between the case in which the side fences 74A and 74B are moved in opposite directions to increase the interval between the side fences 74A and 74B and the case in which the side fences 74A and 74B are moved in opposite directions to decrease the interval between the side fences 74A and 74B. Therefore, the amount of rotations of the gear 84 (in other words, the angle of rotation of the gear 84) is not obtained based on the detection result of the rotary sensor 83 (in other words, the amount of rotations of the rotor 83*a*), and therefore the positions of the side fences 74A and 74B are not obtained accurately. Accordingly, when determining the size in the width direction of the sheet S based on the detection result of the rotary sensor 83 (in other words, the amount of rotations of the rotor 83*a*), the size is not determined properly.

Figure 6:
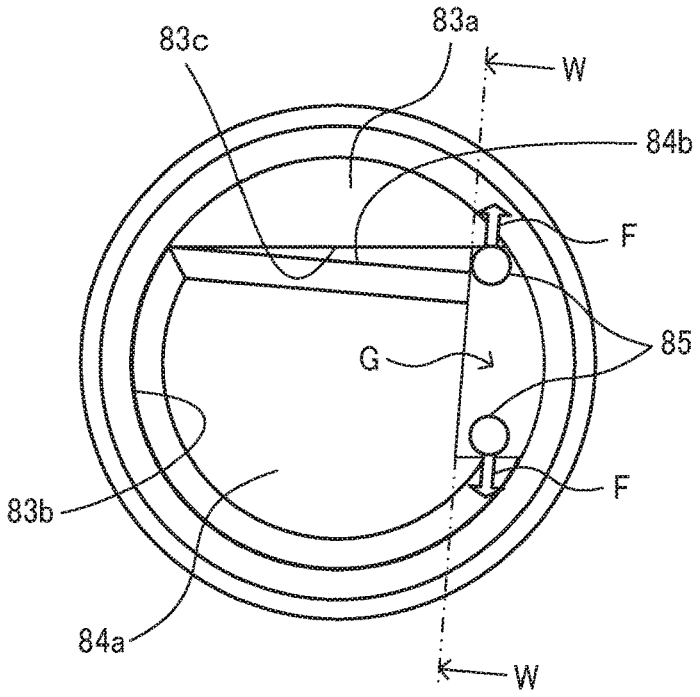
FIG. 6 is a diagram illustrating a configuration of connection of the rotary shaft of a gear and the engagement hole of a rotor.

FIG. 6 is a diagram illustrating a configuration of connection of the rotary shaft 84*a* of the gear 84 and the engagement hole 83*b* of the rotor 83*a*.

In the present embodiment, in order to maintain the contact state of the D-cut face 84*b* of the rotary shaft 84*a* of the gear 84 and the inner wall flat portion 83*c* of the engagement hole 83*b* of the rotor 83*a*, a spring 85 that functions as a biasing body is disposed between the gear 84 and the rotor 83*a* to apply a biasing force to the rotational direction.

In the present embodiment, since the spring 85 is attached to the inside of the engagement hole 83*b* of the rotor 83*a*, a cutout is formed on the rotary shaft 84*a* of the gear 84. Therefore, part of the D-cut face 84*b* is removed to provide space G to attaching the spring 85.

As a biasing member, any biasing member is applied as long as the biasing member applies the above-described biasing force. The biasing member according to the present embodiment is attached inside the engagement hole 83*b* of the rotor 83*a*. However, the setting portion or area of the biasing member is not limited to the above-described setting portion.

The spring 85 according to the present embodiment applies a biasing force in directions indicated by arrow F in FIG. 6. The one end side of the D-cut face 84*b* in the direction perpendicular to the axial direction of the rotary shaft 84*a* (in other words, the end portion on the right side of FIG. 6) is biased in a direction to separate from the inner wall flat portion 83*c* of the engagement hole 83*b*. Due to the above-described biasing force, the contact state between the D-cut face 84*b* and the inner wall flat portion 83*c* of the engagement hole 83*b* is maintained constantly in the contact state (that is, a state in which the one end side of the D-cut face 84*b* and the one end side of the inner wall flat portion 83*c* contact to each other), as illustrated in FIG. 5C.

The biasing force of the spring 85 is set to be equal to or greater than the rotational torque of the rotor 83*a*. Therefore, as illustrated in FIG. 5B, even in a case in which the rotary shaft 84*a* of the gear 84 rotates in the counterclockwise direction in the drawing, the contact state of the D-cut face 84*b* and the inner wall flat portion 83*c* of the engagement hole 83*b* is maintained in the state as illustrated in FIG. 5C. In the contact state, both the gear 84 and the rotor 83*a* rotate together. Accordingly, even if there is the gap C between the D-cut face 84*b* of the rotary shaft 84*a* and the inner wall flat portion 83*c* of the engagement hole 83*b*, the contact state of the D-cut face 84*b* and the inner wall flat portion 83*c* of the engagement hole 83*b* is uniquely determined. Therefore, the amount of rotations of the gear 84 (in other words, the angle of rotation of the gear 84) is obtained accurately based on the detection result of the rotary sensor 83 (in other words, the amount of rotations of the rotor 83*a*). As a result, the positions of the side fences 74A and 74B are accurately grasped from the detection result of the rotary sensor 83 (in other words, the amount of rotations of the rotor 83*a*). Accordingly, in a case in which the size in the width direction of the sheet S is determined based on the detection result of the rotary sensor 83, the determination is appropriately performed.

By contrast, the biasing force of the spring 85 according to the present embodiment of this disclosure is set to be less than the damage allowable pressure of the rotor 83*a*. Therefore, when assembling the gear 84 to the rotor 83*a*, an excessive extemal force that exceeds the damage allowable pressure of the rotor 83*a* is not applied, and therefore there is little concern of failure or damage of the rotary sensor 83.

Further, in the present embodiment, the gap C may exist between the D-cut face 84*b* of the rotary shaft 84*a* and the inner wall flat portion 83*c* of the engagement hole 83*b* of the rotor 83*a*. Therefore, a configuration of connection is not employed to press the rotary shaft 84*a* of the gear 84 to fit into the engagement hole 83*b* of the rotor 83*a*, and no excessive external force is applied to the rotary sensor 83 by this press-fitting. Therefore, there is little concern about failure or damage of the rotary sensor 83.

Next, a further description is given of the configuration of the spring 85.

Figure 7:
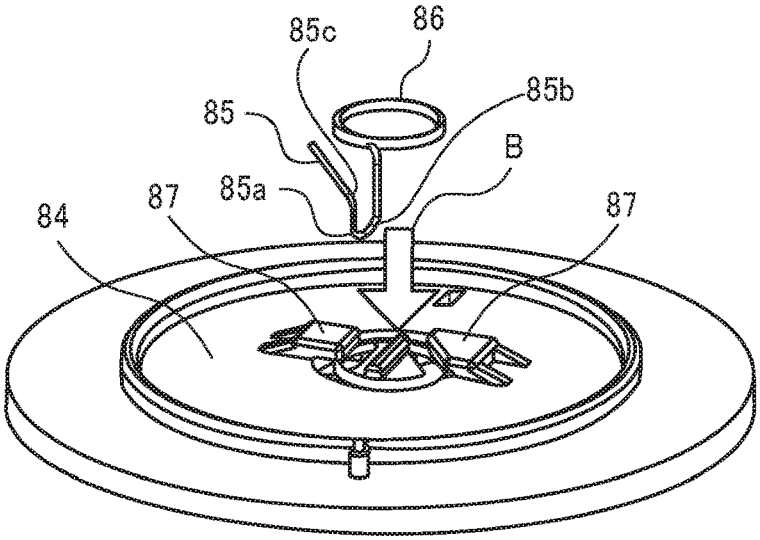
FIG. 7 is a perspective view illustrating a state in which the rotary shaft of the gear is fitted to the engagement hole of the rotor of the rotary sensor, with a spring being not yet attached.

FIG. 7 is a perspective view illustrating a state in which the rotary shaft 84*a* of the gear 84 is fitted to the engagement hole 83*b* of the rotor 83*a* of the rotary sensor 83, with the spring 85 being not yet attached.

The spring 85 according to the present embodiment applies a biasing force by resilience against deformation of a wire made of metal, for example. To be more specific, as illustrated in FIG. 7, the spring 85 has one or more bent portions, which are a leading end bent portion 85*a*, a first bent portion 85*b*, and a second bent portion 85*c* formed by bending a wire. When the leading end bent portion 85*a*, the first bent portion 85*b*, and the second bent portion 85*c* of the spring 85 are deformed in the closing direction or the opening direction, the biasing force is applied by the resilience. Each of the leading end bent portion 85*a*, the first bent portion 85*b*, and the second bent portion 85*c* has an R shape to avoid stress concentration when elastically deformed.

Further, a handle 86 is mounted on one end of the wire that forms the spring 85 of the present embodiment. The other end of the wire is a free end. The handle 86 is used by an operator or a user to grab when assembling the spring 85. In the present embodiment, the handle 86 has a circular outer shape so that the operator can easily hold the handle 86. It is to be noted that a disc member or a ring member may be employed as a handle as long as the outer shape of the handle is a circular shape. The outer shape of the handle 86 is not limited to a circular shape, and may be a different shape.

Figure 8A:
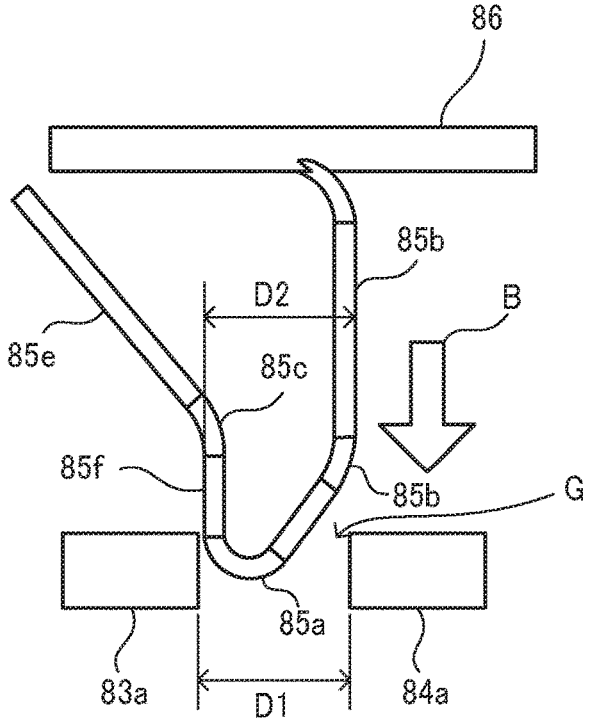
FIG. 8A is a diagram illustrating the shape of the spring before assembly.
Figure 8B:
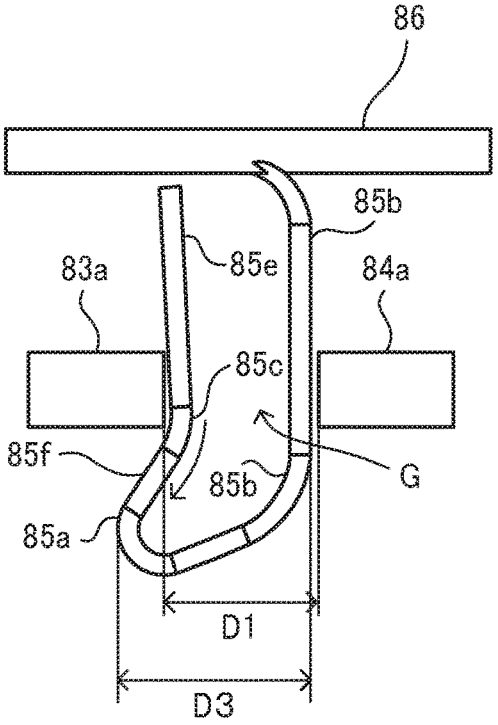
FIG. 8B is a diagram illustrating the shape of the spring after assembly.

FIG. 8A is a diagram illustrating the shape of the spring 85 before assembly of the spring 85. FIG. 8B is a diagram illustrating the shape of the spring 85 after assembly of the spring 85.

When assembling the spring 85, the operator grips the handle 86 of the spring 85 with two fingers. Then, as the operator moves the spring 85 in a direction of a central axis of the handle 86 (in other words, in a vertical direction in the drawing), the leading end bent portion 85*a* of the spring 85 is inserted into the space G in the engagement hole 83*b* of the rotor 83*a* that is formed by cutout of the rotary shaft 84*a* of the gear 84, from the axial direction of the rotary shaft 84*a* as indicated by arrow B in FIG. 7. The spring 85 is inserted from the end face in the axial direction of the gear 84, which is opposite to the side facing the rotary sensor 83.

Here, a first straight portion 85*d* that is formed between the first bent portion 85*b* of the spring 85 and the fixed end of the wire (that is, the end of a wire to which the handle 86 is attached) extends in substantially parallel to the direction of the central axis of the handle 86 having a circular shape. Therefore, when the spring 85 is inserted, the first straight portion 85*d* moves straightly along the surface of the rotary shaft 84*a* that forms the space G in the rotational direction of the rotary shaft 84*a*. By contrast, as illustrated in FIG. 8A, the second straight portion 85*e* between the second bent portion 85*c* of the spring 85 and a free end of the wire (that is, the end portion opposite to the fixed end of the wire) extends slanting downwardly toward a direction separating form the first straight portion 85*d*, to the direction of the central axis of the handle 86, so that the entire shape of the spring 85 is substantially V-shaped. Therefore, when the spring 85 is inserted, the second straight portion 85*e* contacts the inner wall flat portion 83*c* of the rotor 83*a* that forms the space G in the rotational direction of the rotary shaft 84*a*. As a result, the spring 85 is elastically deformed so that the second straight portion 85*e* approaches the first straight portion 85*d*.

Further, with this elastic deformation, the leading end bent portion 85*a* of the spring 85 moves to a position at which the leading end bent portion 85*a* goes around the back side of the rotor 83*a* (in other words, the leading end side in a spring inserting direction). As a result, as illustrated in FIG. 8B, the spring 85 is retained in a position at which the leading end bent portion 85*a* is located outside the space G in a direction of a surface perpendicular to the axial direction of the rotary shaft 84*a* (that is, the horizontal direction in FIG. 8B). Accordingly, the third straight portion 85*f* that is formed between the leading end bent portion 85*a* and the second bent portion 85*c* is caught by the back side of the rotor 83*a*, and therefore the spring 85 does not easily come out from the space G.

The configuration as described above is achieved by the shape of the spring 85 of the present embodiment. That is, as illustrated in FIG. 8A, the spring 85 according to the present embodiment before assembly has the shape in which the first straight portion 85*d* and the third straight portion 85*f* extend in substantially parallel to each other in the direction of the central axis of the handle 86 having a circular shape. A distance D2 between the first straight portion 85*d* and the third straight portion 85*f* is set smaller (narrower) than a distance D1 of the space G. Further, as illustrated in FIG. 8B, the shape of the spring 85 according to the present embodiment after assembly is set to have the maximum distance of the spring 85 that has gone around the back side of the rotor 83*a*, in other words, a distance D3 between the first straight portion 85*d* and the leading end bent portion 85*a* is set to greater (wider) than the distance D1 of the space G.

Figure 9:
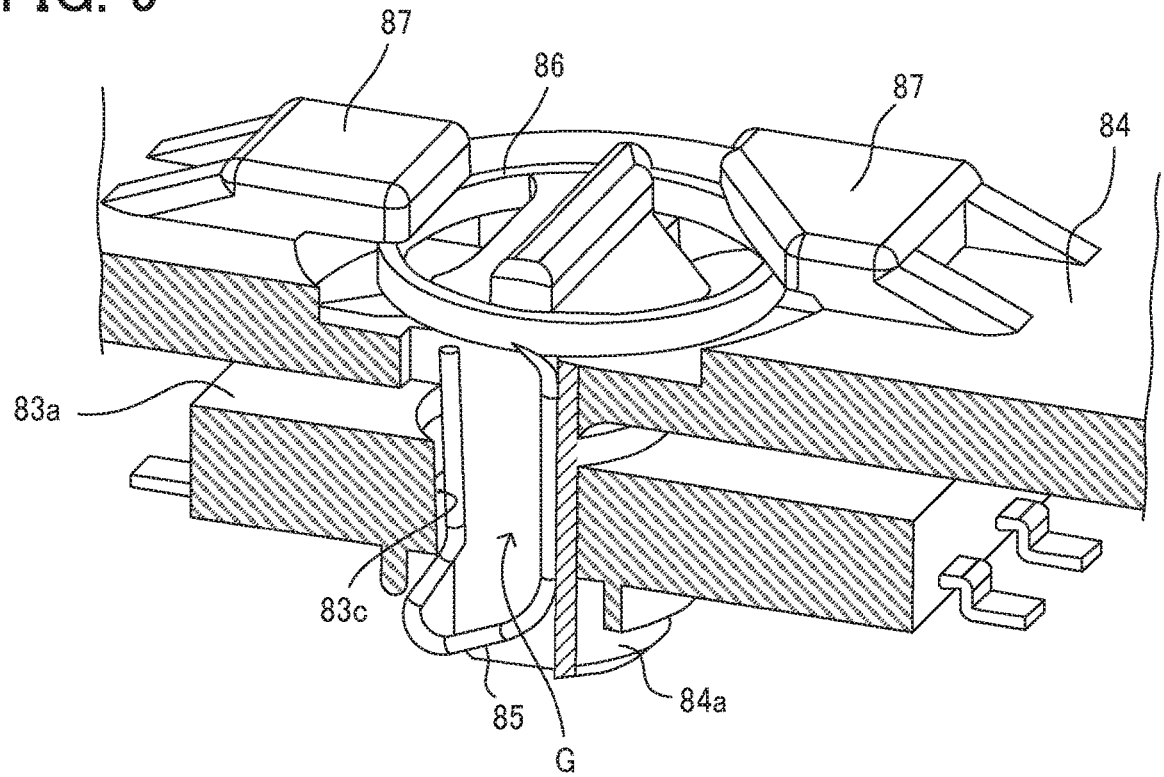
FIG. 9 is a perspective view illustrating a state in which the rotary shaft of the gear is fitted to the engagement hole of the rotor of the rotary sensor, with the spring being attached.

FIG. 9 is a partial cross-sectional perspective view illustrating a state in which the rotary shaft 84*a* of the gear 84 is fitted to the engagement hole 83*b* of the rotor 83*a* of the rotary sensor 83, with the spring 85 being attached.

It is to be noted that the cross sectional portion illustrated in FIG. 9 is taken along a line W-W in FIG. 6.

Figure 10:
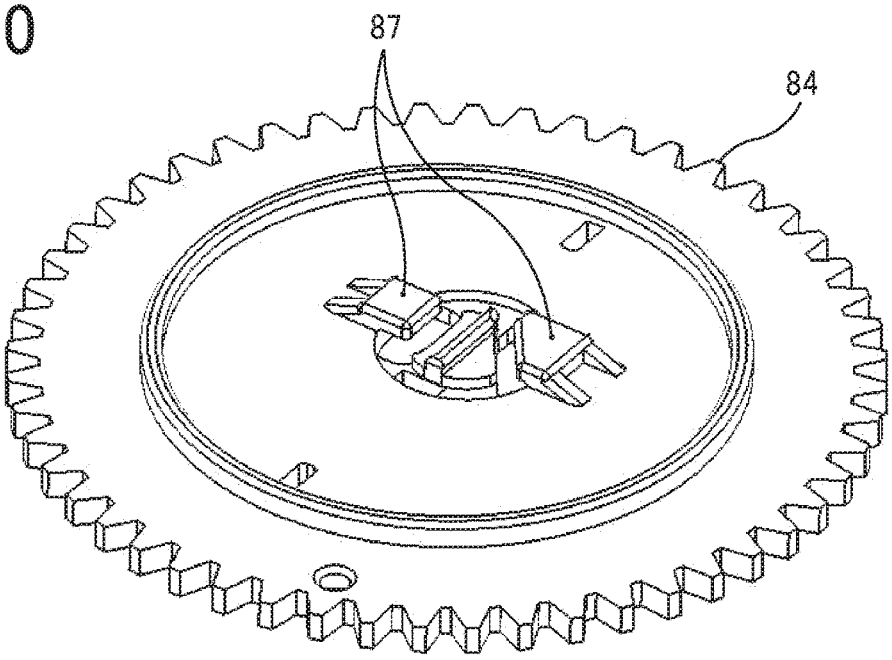
FIG. 10 is a perspective view illustrating the gear.
Figure 11:
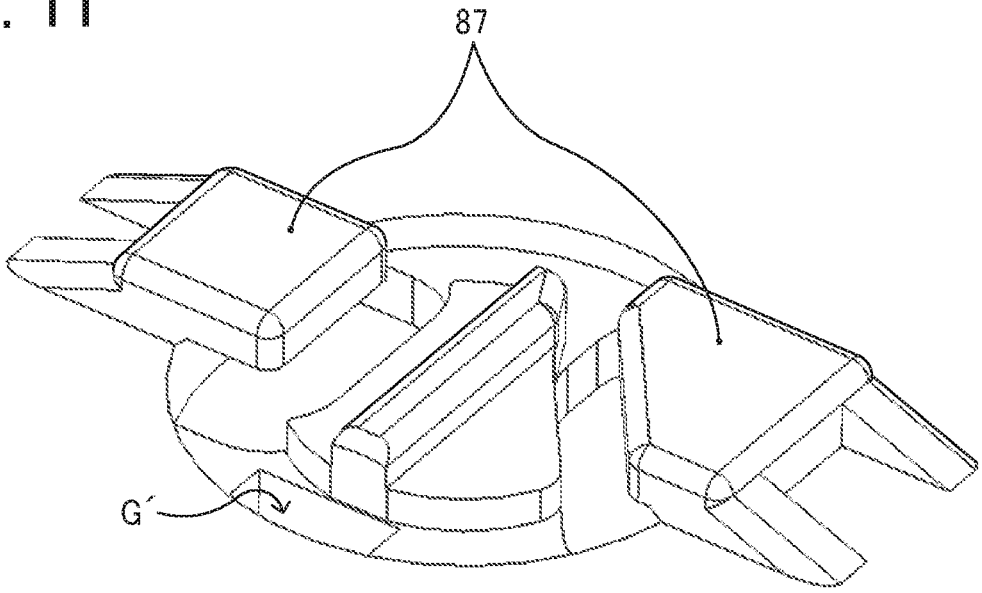
FIG. 11 is an enlarged view illustrating of a gear having a portion on which eaves is mounted to restrain the spring from come out from space.
Figure 12:
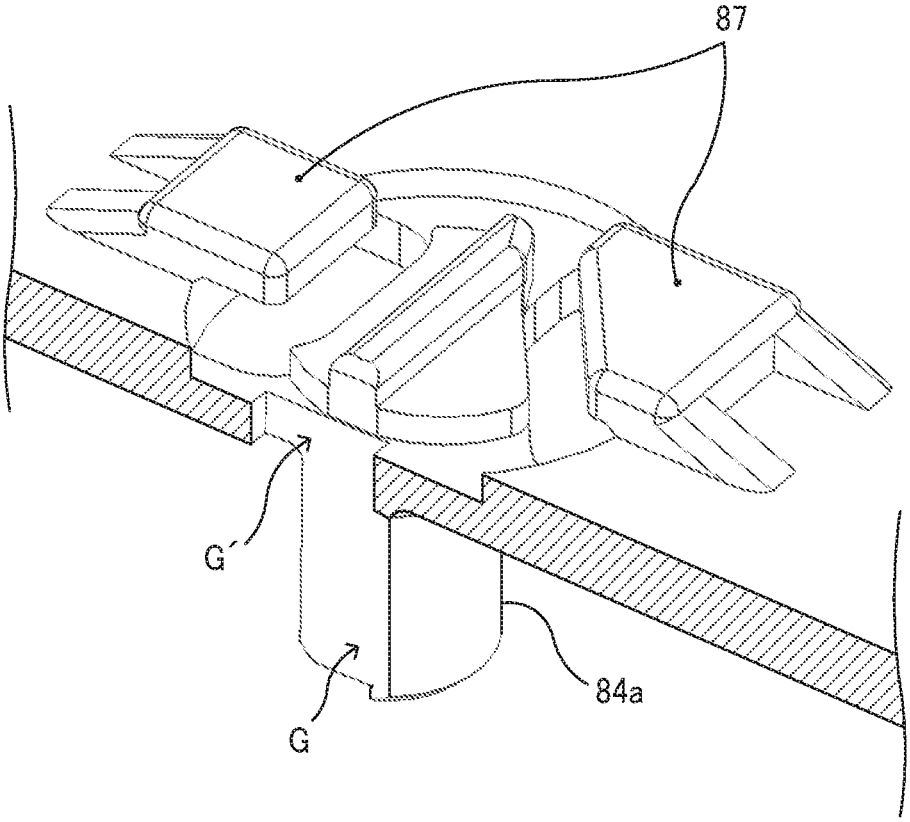
FIG. 12 is a partially cross-sectional perspective view illustrating the gear of FIG. 11.

FIG. 10 is a perspective view illustrating the gear 84 alone. FIG. 11 is an enlarged view illustrating of the gear 84 having a portion on which eaves 87 are mounted to restrain or prevent the spring 85 from come out from the space G. FIG. 12 is a partially cross-sectional perspective view illustrating the gear 84 of FIG. 11.

In the present embodiment, the eaves 87 are provided as a separation stopper that restrains or prevents the spring 85 attached to the space G from separating from the space G. The eaves 87 are mounted on the axial side face of the gear 84, that is opposite to the side into which the spring 85 is inserted. In other words, the eaves 87 are mounted on the end face opposite to the side facing the rotary sensor 83. One end side of each of the eaves 87 is fixed to the axial end face of the gear 84, and the other end side of each of the eaves 87 is provided so as to protrude toward the rotary shaft 84*a* of the gear 84.

The spring 85 is inserted into the space G via a spring receiving port G' that is provided to the gear 84. When the spring 85 is inserted into the space G, the protruding portion of the eaves 87 contacts the handle 86 of the spring 85 from the rear side in the insertion direction. By so doing, the spring 85 is restrained or prevented from being separated from the space G. It is to be noted that, when the spring 85 is inserted, an operator or a user holds the handle 86 by the fingers to elastically deform the handle 86, so that the spring 85 climbs over the protruding portion of the eaves 87.

Figure 13A:
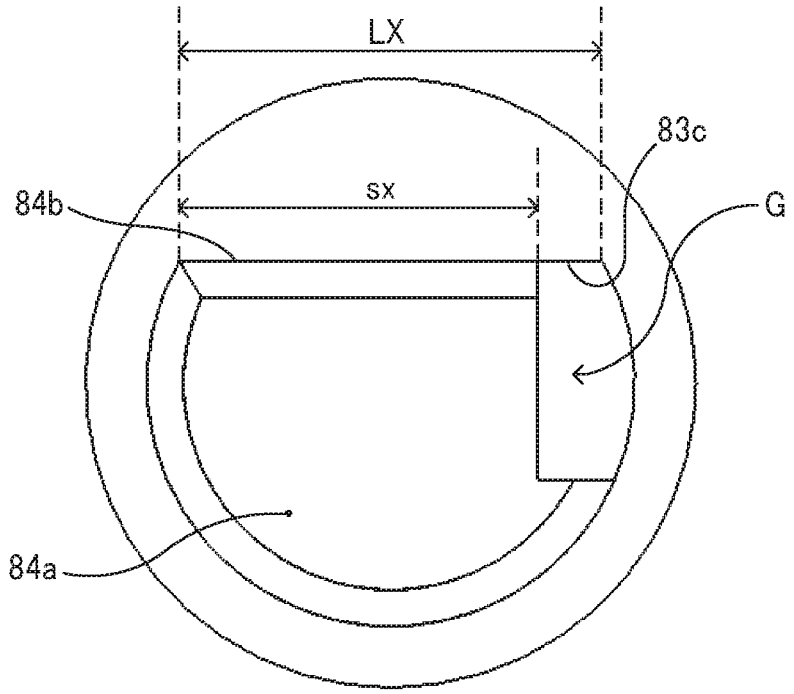
FIG. 13A is a diagram illustrating a state in which the length of a D-shaped face and the length of a cutout are in the relation to rotate a rotor and a gear together, in the cross section of the gear in a direction perpendicular to the axial direction of the gear.
Figure 13B:
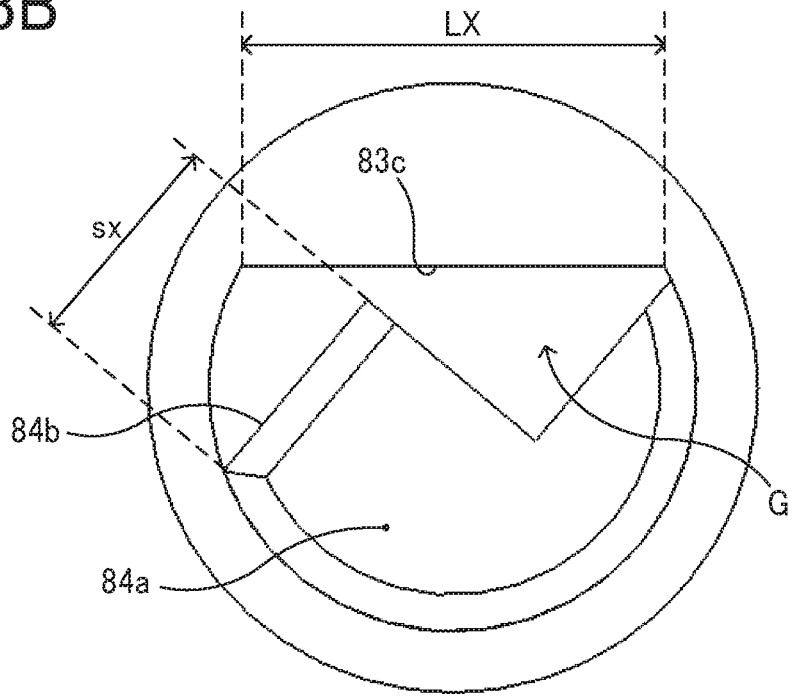
FIG. 13B is a diagram illustrating a state in which the length of the D-shaped face and the length of the cutout are in the relation not to rotate the rotor and the gear together, in the cross section of the gear in a direction perpendicular to the axial direction of the gear.

It is to be noted that, to couple the rotary sensor 83 of the rotary sensor 83 and the gear 84 in the present embodiment, a D-shaped shaft is employed as the rotary shaft 84*a* of the gear 84 and the engagement hole 83*b* of the rotor 83*a* is formed to a D-cut shape. According to this configuration, the rotor 83*a* and the gear 84 rotate together. At this time, as illustrated in FIG. 13B, in a case in which the length sx of the D-cut face 84*b* becomes smaller than and equal to LX/2 in the cross section perpendicular to the axial direction of the rotary shaft 84*a* of the gear 84, the rotor 83*a* and the gear 84 would not rotate together. It is to be noted that "LX" represents the length of the inner wall flat portion 83*c*. Therefore, as illustrated in FIG. 13A, the length sx of the D-cut face 84*b* is set to be in a relation in which the rotor 83*a* and the gear 84 rotate together.

Figure 14:
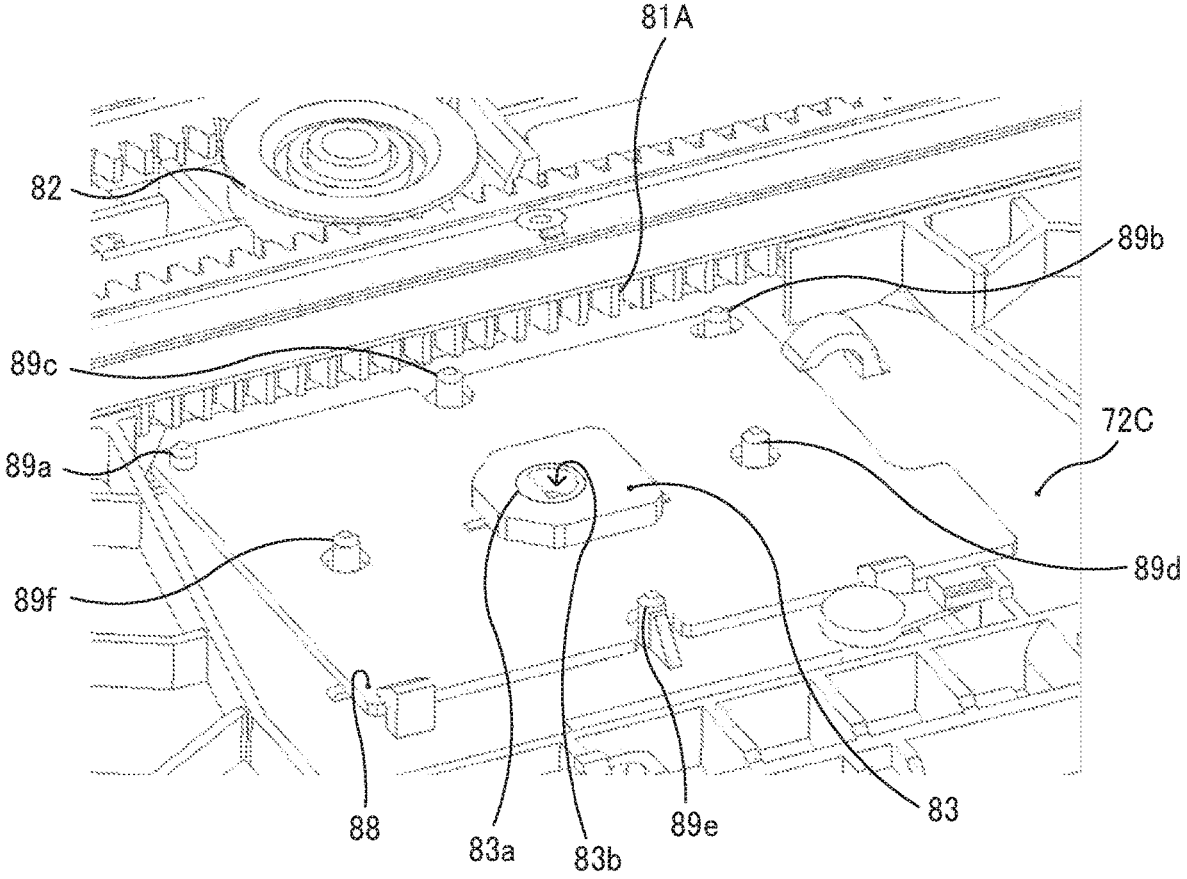
FIG. 14 is a perspective view illustrating a state in which the gear is removed from a rotary sensor.
Figure 15:
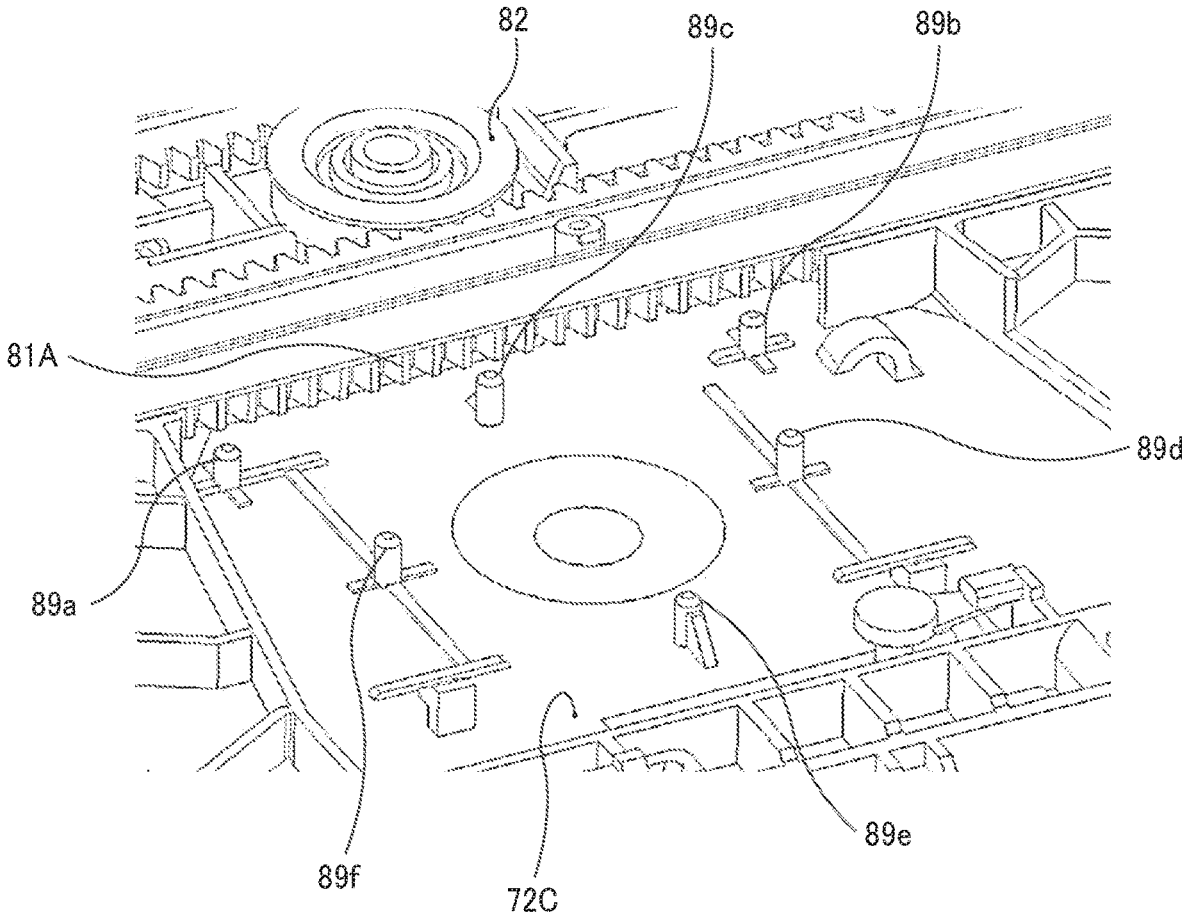
FIG. 15 is a perspective view illustrating a state in which the rotary sensor is removed from a base of a bypass tray.
Figure 16:
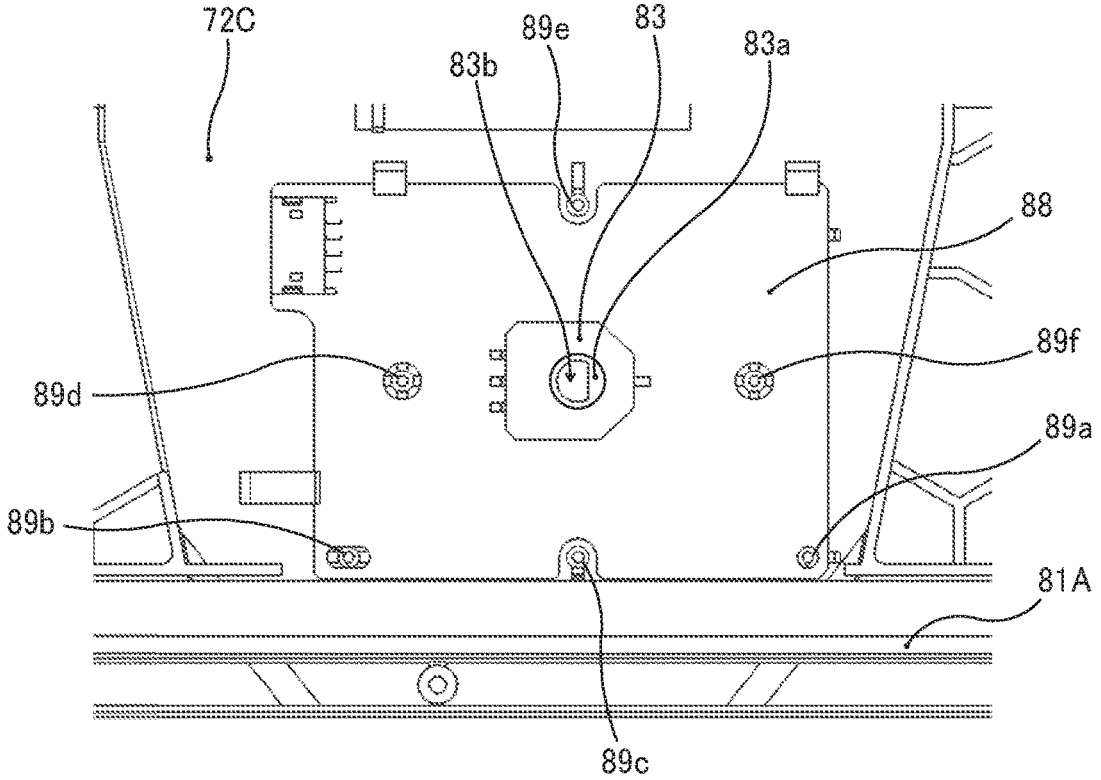
FIG. 16 is a plan view illustrating a state in which the gear is removed from the rotary sensor.
Figure 17:
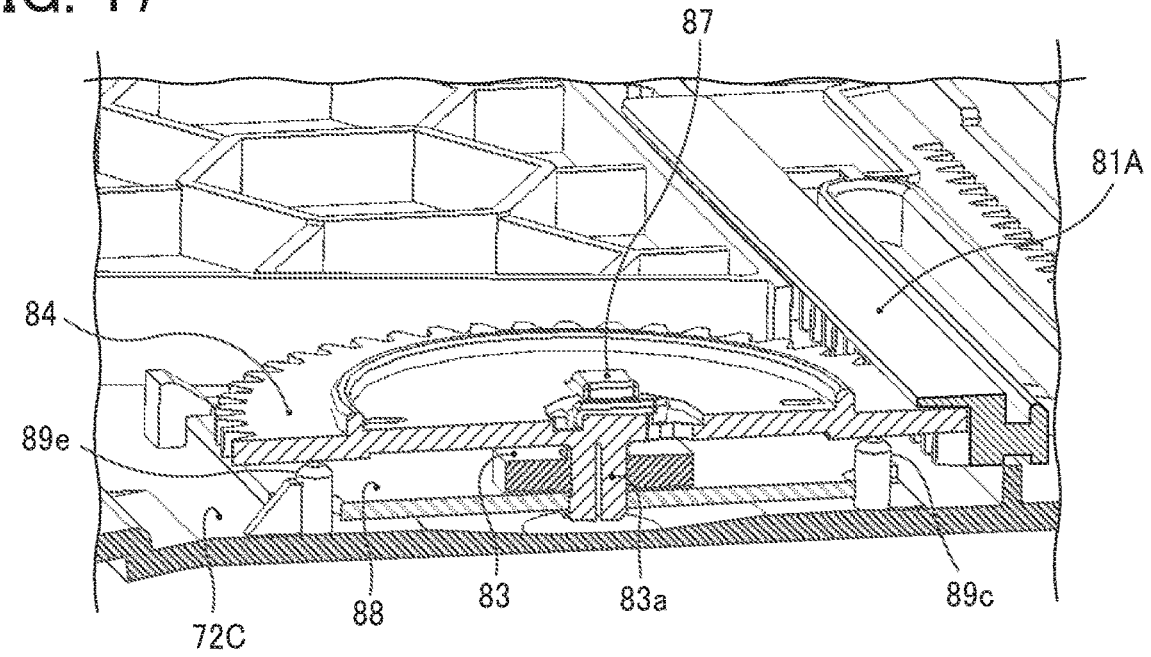
FIG. 17 is a partially cross-sectional perspective view illustrating the rotary sensor with the gear being mounted and an area near the rotary sensor.
Figure 18:
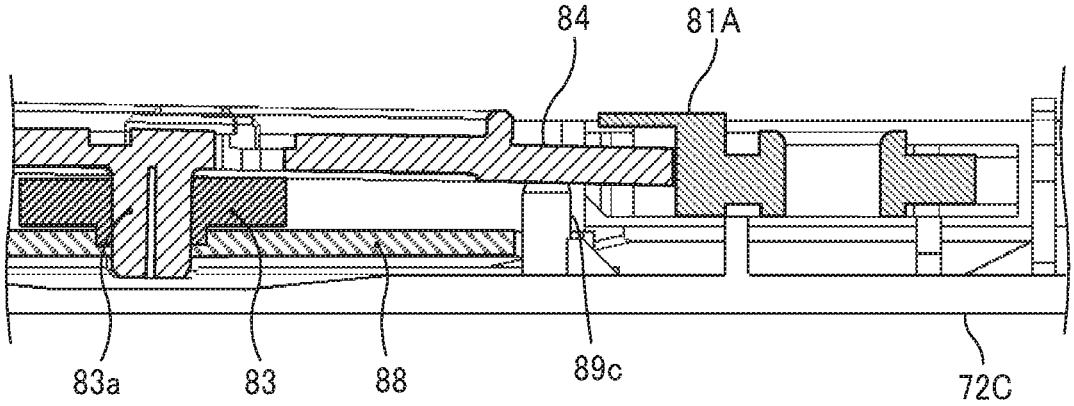
FIG. 18 is a cross-sectional view illustrating an area near a meshing portion of the gear and a rack.

FIG. 14 is a perspective view illustrating a state in which the gear 84 is removed from the rotary sensor 83. FIG. 15 is a perspective view illustrating a state in which the rotary sensor 83 is removed from a base 72C of the bypass tray 72. FIG. 16 is a plan view illustrating a state in which the gear 84 is removed from the rotary sensor 83. FIG. 17 is a perspective view illustrating the rotary sensor 83 with the gear 84 attached to the rotary sensor 83 and parts around the rotary sensor 83. FIG. 18 is a cross-sectional view illustrating an area near the meshing portion of the gear 84 and the rack 81A.

The rotary sensor 83 according to the present embodiment is mounted on a sensor board 88 that is installed on the base 72C of the bypass tray 72. The sensor board 88 is positioned on the base 72C by a positioning main reference boss 89*a* and a positioning sub reference boss 89*b*, both provided on the base 72C.

Here, when the side fence 74A is moved, the rack 81A moves together with the side fence 74A and the gear 84 that is meshed with the rack 81A clatters. If there is a relatively large degree of clattering of the gear 84 (in other words, a relatively large displacement of the gear 84), the meshing of the rack 81A and the gear 84 is disengaged. Therefore, the correspondence relation of the side fence 74A and the amount of rotations of the rotor 83*a* to which the gear 84 is attached collapses, and therefore the size in the width direction of the sheet S is not determined appropriately when the sheet S is set on the bypass tray 72.

In order to address this inconvenience, as illustrated in FIG. 15, clattering restraining bosses 89*c*, 89*d*, 89*e*, and 89*f* are mounted on the base 72C of the present embodiment, different from the positioning main reference boss 89*a* and the positioning sub reference boss 89*b* of the sensor board 88. The clattering restraining bosses 89*c*, 89*d*, 89*e*, and 89*f* restrain or prevent clattering of the gear 84 (i.e., the displacement of the gear 84). As illustrated in FIGS. 14 and 16, the sensor board 88 has holes (openings) and cutouts to mate with the clattering restraining bosses 89*c*, 89*d*. 89*e*, and 9*f*.

The sensor board 88 is mounted on the base 72C so that the holes and the cutouts of the sensor board 88 engage with the clattering restraining bosses 89*c*, 89*d*, 89*e*, and 89*f*, and therefore the displacement (clattering) of the sensor board 88 on which the gear 84 is fixed is regulated. As a result, clattering of the gear 84 when moving the side fence 74A is restrained or prevented.

Variation 1.

Next, a description is given of an exemplary modified configuration of the spring according to the present embodiment. Hereinafter, the exemplary modified configuration is referred to as "Variation 1."

Figure 19:
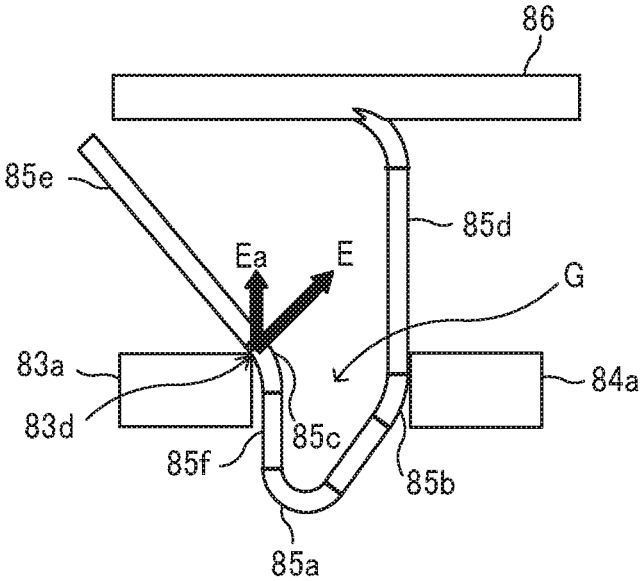
FIG. 19 is a diagram illustrating a reaction to resilience (an elastic force) of elastic deformation of a spring, which is applied by inserting the leading bent portion of the spring into space of the rotor and contacting the spring to the entrance edge portion of the space of the rotor, when the spring is attached.

In the spring 85 according to the above-described embodiment, when the spring 85 is inserted into the space G that is formed by making cutout in the rotary shaft 84*a* of the gear 84, as illustrated in FIG. 19, the second straight portion 85*e* contacts an inlet port edge 83*d* of the space G of the rotor 83*a*. By so doing, the spring 85 is elastically deformed to approach the first straight portion 85*d*. At this time, as illustrated in FIG. 19, the second straight portion 85*e* of the spring 85 receives reaction E to the resilience of elastic deformation (i.e., an elastic force) of the spring 85, from the inlet port edge 83*d* of the space G. The reaction E has a component force Ea that is applied in a direction opposite to the inserting direction of the spring 85 (in other words, in the upward direction in FIG. 19). The reaction E acts to pull the spring 85 out of the space G. Therefore, when the spring 85 is inserted (assembled), it is likely that the elastic force of the spring 85 pops out to come out from the space G.

Further, in a case in which the gear 84 is assembled with the spring 85 being inserted insufficiently, the spring 85 is moved in a direction to come out from the space G due to the elastic force of the spring 85 after the assembly. Therefore, it is likely that the sufficient biasing force is not applied in the rotational direction of the gear 84 between the gear 84 and the rotor 83*a*.

Figure 20A:
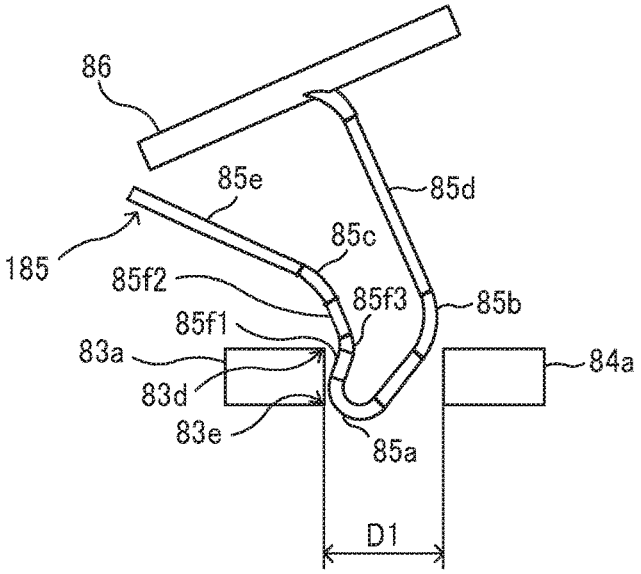
FIG. 20A is a diagram illustrating a shape of the spring before assembly in Variation 1.
Figure 20B:
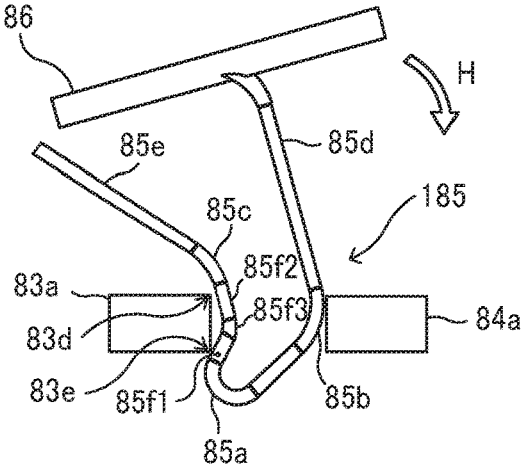
FIG. 20B is a diagram illustrating the shape of the spring during assembling of the spring.
Figure 20C:
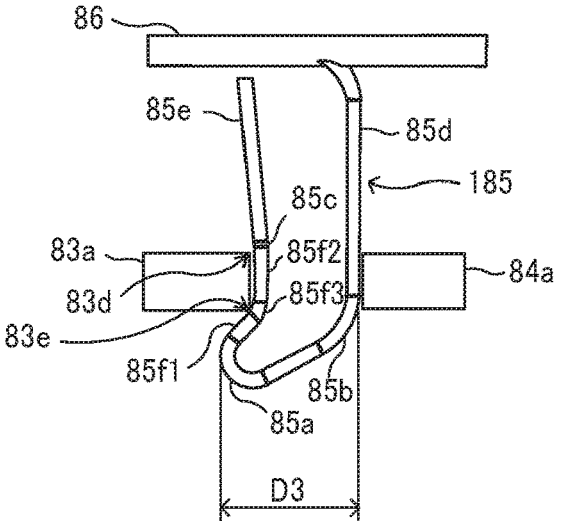
FIG. 20C is a diagram illustrating the shape of the spring after the assembly.

FIG. 20A is a diagram illustrating the shape of a spring 185 before the assembly in Variation 1. FIG. 20B is a diagram illustrating the shape of the spring 185 during assembling of the spring 185. FIG. 20C is a diagram illustrating the shape of the spring 185 after the assembly.

In Variation 1, as illustrated in FIG. 20A, an operator or a user inserts the leading end bent portion 85*a* of the spring 185 into the space G of the rotor 83*a*.

Here, in the spring 185 of Variation 1, a fourth straight portion 85*f*1 and a fifth straight portion 85*f*2, and a third bent portion 85*f*3 that connects the fourth straight portion 85*f*1 and the fifth straight portion 85*f*2 are provided, in addition to the third straight portion 85*f* of the above-described embodiment. Thus, before the second straight portion 85*e* contacts the inlet port edge 83*d* of the space G of the rotor 83*a* to receive the reaction E against the resilience (i.e., the elastic force) of the elastic deformation of the spring 185, the leading end bent portion 85*a* of the spring 185 climbs over an outlet port edge 83*e* of the space G, as illustrated in FIG. 20B.

As described above, at the timing at which the spring 185 according to Variation 1 receives the reaction E against the resilience of elastic deformation (i.e., the elastic force) of the spring 185, the leading end bent portion 85*a* of the spring 185 has already climbed over the outlet port edge 83*e* of the space G. Therefore, at this timing, the spring 185 is inserted into the space G while operating the handle 86 to rotate in a direction indicated by arrow H in FIG. 20B. By so doing, while the fourth straight portion 85*f*1 is being hooked on the back side of the rotor 83*a*, the spring 185 is elastically deformed the spring 185 to cause the second straight portion 85*e* to approach the first straight portion 85*d*. Therefore, even if the spring 185 receives the reaction E having the component force Ea in the direction opposite to the inserting direction of the spring 185, the spring 185 is restrained or prevented from pooping out and coming out from the space G due to the hooking of the fourth straight portion 85*f*1.

Variation 2.

Next, a description is given of another exemplary modified configuration of the handle according to the present embodiment. Hereinafter, the exemplary modified configuration is referred to as "Variation 2."

Figure 21:
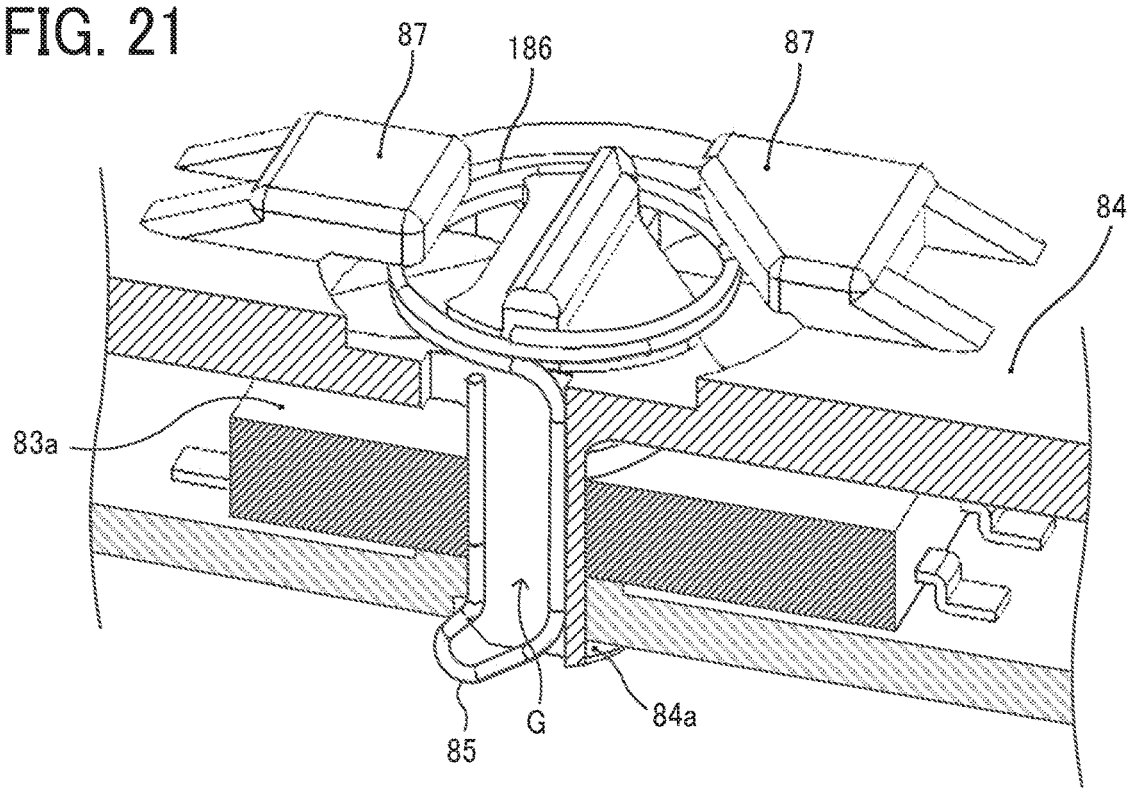
FIG. 21 is a perspective view illustrating a handle in Variation 2.

FIG. 21 is a perspective view illustrating a handle 186 according to Variation 2.

It is to be noted that, similar to FIG. 9, FIG. 21 is a partially cross-sectional perspective view illustrating a state in which the rotary shaft 84*a* of the gear 84 is fitted and engaged with the engagement hole 83*b* of the rotor 83*a* of the rotary sensor 83, with the spring 85 being attached to the rotary sensor 83.

The handle 86 of the above-described embodiment is formed by a different member separated from the spring 85. By contrast, the handle 186 of Variation 2 is formed by winding one end side of a wire that forms the spring 85 into a coil shape. By so doing, when compared with the configuration employing the handle 86 and the spring 85 separately, the number of parts is reduced, and therefore a reduction in cost is achieved.

However, in Variation 2, since the handle 186 is formed by winding one end side of the wire that forms the spring 85 into a coil shape, the following problem is likely to occur. That is, even after assembly, the second straight portion 85*e* of the spring 85 receives the reaction E against the resilience (the elastic force) of elastic deformation of the spring 85 from the inlet port edge 83*d* of the space G, and a force may act in a direction in which the spring 85 shifts or comes out of the space G.

Figure 22:
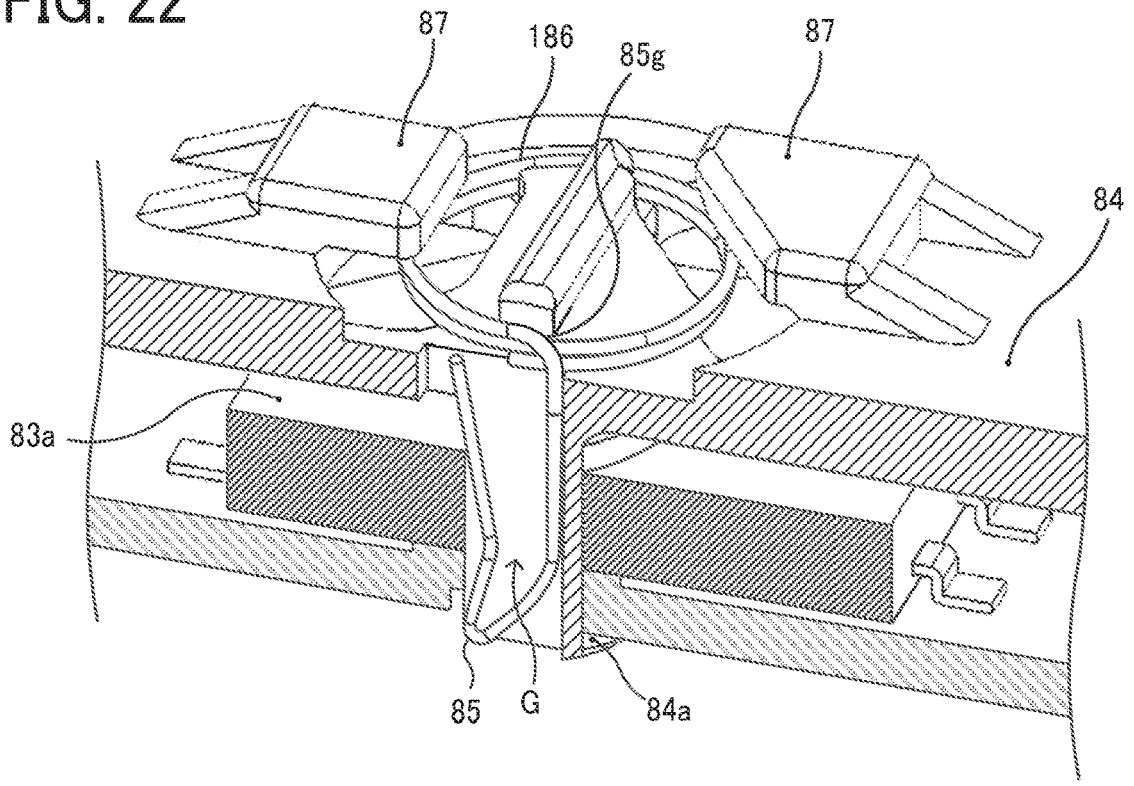
FIG. 22 is a perspective view illustrating a state in which a connecting portion of the spring and the handle is lifted to be reversed in a direction of winding of a wire that includes the handle.

Normally, even if such a force is applied, the spring 85 is restrained or prevented from coming out of the space G by a force applied for the third straight portion 85*f* of the spring 85 to hook on the back side of the rotor 83*a* and a force applied for pressing the protruding portion of the eaves 87 to the handle 186 of the spring 85. However, in a case of using the handle 186 having a coil shape that is formed by winding one end side of the wire that forms the spring 85 into a coil shape, when a force that acts in the direction in which the spring 85 shifts or comes out of the space G, after assembly, a connecting portion 85*g* at which the spring 85 and the handle 186 are coupled to each other is lifted. Then, it is likely that the wire that forms the handle 186 is wound in a reverse winding direction, as illustrated in FIG. 22. In such a state, even if the protruding portion of the eaves 87 presses the handle 186 of the spring 85, the spring 85 moves in the direction of coming out of the space G by the amount that the connecting portion 85*g* has lifted, and the third straight portion 85*f* of the spring 85 is hooked to the back side of the rotor 83*a* insufficiently. As a result, it is not likely that a sufficient biasing force in the rotational direction is applied between the gear 84 and the rotor 83*a*.

In addition, as the third straight portion 85*f* of the spring 85 is not sufficiently hooked to the back side of the rotor 83*a*, the rotary shaft 84*a* of the gear 84 is easily moved in a direction in which the gear 84 comes out of the engagement hole 83*b* of the rotor 83*a* of the rotary sensor 83. As a result, in a case in which the gear 84 that is meshed with the rack 81A that moves together with the side fence 74A clatters, it is likely that the meshing of the gear 84 and the rack 81A is disengaged.

Therefore, in the case of using the handle 186 having a coil shape that is formed by winding one end side of the wire that forms the spring 85 into a coil shape, as described in Variation 2, the shape of the spring 185 described in Variation 1 may be employed. That is, at the timing of receiving the reaction E against the resilience (i.e., the elastic force) of elastic deformation of the spring 185, the leading end bent portion 85*a* of the spring 185 has already climbed over the outlet port edge 83*e* of the space G. According to the above-described configuration, even when receiving the reaction E against the resilience (i.e., the elastic force) of elastic deformation of the spring 185, the fourth straight portion 85*f*1 of the spring 185 is hooked to the back side of the rotor 83*a*, and therefore the connecting portion 85*g* of the spring 185 and the handle 186 is not lifted. Accordingly, the winding direction of the wire that forms the handle 186 does not go in the reverse winding state. Therefore, even if the gear 84 that is meshed with the rack 81A that moves together with the side fence 74A clatters, the meshing of the gear 84 and the rack 81A is restrained from disengagement.

As described above, the present embodiment (including Variation 1 and Variation 2) has the configuration in which two side fences, which are the side fence 74A and the side fence 74B, move together. However, this disclosure is also applicable to a configuration in which the side fence 74A and the side fence 74B move individually or to a configuration in which either one of the side fence 74A and the side fence 74B moves.

In addition, the present embodiment (including Variation 1 and Variation 2) is applied to the side fence 74A and the side fence 74B that contact to each other and separate from each other in the sheet width direction that is perpendicular to the sheet conveying direction. However, this disclosure is also applicable to an end fence that contacts to and separate from the sheet end portion along the sheet conveying direction.

Further, in the present embodiment (including Variation 1 and Variation 2), the gear 84 has the D-shaped shaft and the rotor 83*a* has the D-cut engagement hole. However, this disclosure is also applicable to a configuration in which the gear 84 has the D-cut engagement hole and the rotor 83*a* has the D-shaped shaft.

Furthermore, in the present embodiment (including Variation 1 and Variation 2), the bypass tray 72 is employed. However, as long as the sheet is held, any device or unit such as a sheet stacking portion provided to the sheet separating device 61 of the sheet feeding device 4, the ejected sheet stacking portion 39, and a loading table of the automatic document feeder 5 is applicable to this disclosure.

The configurations according to the above-descried embodiments are not limited thereto. This disclosure can achieve the following aspects effectively.

Aspect 1.

In Aspect 1, a sheet holder (for example, the bypass tray 72) includes a regulator (for example, the side fences 74A and 74B), the side fences 74A and 74B), a rotary body (for example, the gear 84), a detection target (for example, the rotor 83*a*), a rotational position detector (for example, the rotary sensor 83), and a biasing body (for example, the spring 85). The regulator moves in directions to approach an end portion of a sheet (for example, the sheet S) and separates from the end portion of the sheet. The rotary body has a contact portion (for example, the D-cut face 84*b*). The rotary body rotates according to movement of the regulator. The detection target is attached to the rotary body and has a contact target portion (for example, the inner wall flat portion 83*c*). The detection target rotates together with the rotary body by contacting of the contact portion of the rotary body with the contact target portion of the detection target in a rotational direction of the rotary body. The rotational position detector detects a rotational position of the detection target. The biasing body applies a biasing force (for example, the biasing force F) between the rotary body and the detection target to maintain a contact state of the contact portion of the rotary body and the contact target portion of the detection target.

In order to connect the rotary body and the detection target, it is general to employ a configuration in which a D-shaped shaft having a D-shaped face (that functions as a contact portion or a contact target portion) is provided to one of the rotary body and the detection target and an opening having a D-cut shape is provided to the other of the rotary body and the detection target, so that an inner wall face (that is the contact target portion or the contact portion) is formed to engage with the D-cut shape of the opening. However, in this structure, it is likely that a gap C is generated between the D-cut face and the inner wall face of the opening due to the dimensional variation of the opening having the D-shaped face and the D-shaped shaft that is fitted to the opening having the D-shaped face With a gap such as the gap C, the relation of the angle of rotation of the rotary body and the angle of rotation of the detection target is not uniquely determined, and therefore the angle of rotation of the rotary body is not correctly obtained based on the angle of rotation of the detection target. As a result, the position of the regulator is not accurately grasped, and the sheet size is not properly determined.

In Aspect 1, the contact state between the contact portion of the rotary body and the contact target portion of the detection target is uniquely maintained by the biasing force of the biasing body. According to the above-described configuration, even if there is the gap C between the contact portion of the rotary body and the contact target portion of the detection target, the contact state between the contact portion of the rotary body and the contact target portion of the detection target is maintained. As a result, the relation of the angle of rotation of the rotary body and the angle of rotation of the detection target is determined. Therefore, the rotation angle of the rotary body is detected with high accuracy, and the position of the regulator is also detected with high accuracy. Therefore, for example, when detecting the size of the sheet according to the position of the regulator, the size of the sheet is detected with high accuracy.

Moreover, in Aspect 1, even if there is a gap between the contact portion of the rotary body and the contact target portion of the detection target, the angle of rotation of the rotary body is accurately detected. Therefore, the configuration of connection to press the rotary body and the detection target against each other is not employed. In such a configuration of connection, when pressing the rotary body and the detection target against each other, an excessive external force is applied to the rotational position detector via the detection target, and failure or damage of the rotational position detector is concerned. However, with the above-described configuration of Aspect 1, there is little concern of such failure or damage of the rotational position detector.

Aspect 2.

In Aspect 2, the sheet holder according to Aspect 1 further includes a rotary shaft (for example, the rotary shaft 84*a*) and an engaging opening (for example, the engagement hole 83*b*). The rotary shaft is provided to one of the rotary body and the detection target. The engaging opening is provided to another of the rotary body and the detection target. One of the contact portion of the rotary body and the contact target portion of the detection target is provided on a circumferential surface of the rotary shaft. Another of the contact portion of the rotary body and the contact target portion of the detection target is provided on an inner wall surface of the engaging opening. The biasing body is attached inside the engaging opening.

According to this configuration, since the biasing body is attached to the inside of the engaging opening, the biasing body does not easily get in the way.

Aspect 3.

In Aspect 3, the rotary shaft of Aspect 2 is a D-shaped shaft (for example, the rotary shaft 84*a*). The one of the contact portion of the rotary body and the contact target portion of the detection target, provided on the circumferential surface of the rotary shaft, is a D-cut face (for example, the D-cut face 84*b*) of the D-shaped shaft. Said another one of the contact portion of the rotary body and the contact target portion of the detection target, provided on the inner wall surface of the engaging opening, is an engaging surface (for example, the inner wall flat portion 83*c*) to engage with the D-cut face.

According to this configuration, in the configuration of connection using the D-shaped shaft that is generally employed, there is no concern of the failure or damage of the rotational position detector by pressing, and therefore the angle of rotation of the rotary body is detected from the detection result of the rotational position detector with high accuracy.

Aspect 4.

In Aspect 4, the biasing body of Aspect 3 biases the engaging surface in a direction in which one end side of the D-cut face 84*b* in a direction perpendicular to an axial direction of the rotary shaft of the rotary body separates from the engaging surface.

According to this configuration, the contact state between the contact portion of the rotary body and the contact target portion of the detection target is maintained constantly in the contact state. Accordingly, the contact state is maintained with a simple configuration.

Aspect 5.

In Aspect 5, the biasing body according to Aspect 4 is a spring (for example, the spring 85) made of a wire to apply the biasing force by resilience against deformation of the wire.

According to this configuration, it is easy to install the biasing body even in a narrow space.

Aspect 6.

In Aspect 6, the spring according to Aspect 5 includes one or more bent portions (for example, of the leading end bent portion 85*a*, the first bent portion 85*b*, and the second bent portion 85*c*) formed by bending the wire. The spring applies the biasing force by the resilience against deformation of the wire when the one or more bent portions are deformed in one of a closed direction and an open direction.

According to this configuration, the biasing body that is easily installed in a narrow space is provided with a simple configuration.

Aspect 7.

In Aspect 7, at least one (for example, the leading end bent portion 85*a*) of the one or more of bent portions of the spring is inserted through the engaging opening and is retained in a position at which the at least one of the one or more bent portions is located outside the engaging opening in a direction of a surface perpendicular to the axial direction of the rotary shaft.

According to this configuration, the spring that is inserted into the engaging opening is hooked at the edge of the engaging opening, so that the spring does not easily come out from the engaging opening.

Aspect 8.

In Aspect 8, the spring according to Aspect 7 takes a shape in which the at least one of the plurality of bent portions of the spring has passed the engaging opening at a timing of generating the biasing force of the spring when the spring is attached.

According to this configuration, the spring that is inserted to the engaging opening is restrained or prevented from easily coming off from the engaging opening.

Aspect 9.

In Aspect 9, the sheet holder further includes a separation stopper (for example, the eaves 87) to restrain or prevent separation of the biasing body attached to the engaging opening, from the engaging opening.

According to this configuration, the spring that is inserted to the engaging opening is restrained or prevented from easily coming off from the engaging opening.

Aspect 10.

In Aspect 10, the biasing body according to any one of Aspect 1 through Aspect 9 includes a handle (for example, the handle 86).

According to this configuration, the biasing body is easily handled by an operator.

Aspect 11.

In Aspect 11, an outer shape of the handle according to Aspect 10 is a circular shape.

According to this configuration, the handle is easily gripped by the operator.

Aspect 12.

In Aspect 12, a sheet conveying device (for example, the bypass sheet feeding device 70 and the sheet feeding device 4) includes the sheet holder (for example, the bypass tray 72) according to any one of Aspect 1 through Aspect 11, to hold a sheet (for example, the sheet S) to be fed by the sheet feeding device.

According to this configuration, a sheet holder capable of accurately detecting the angle of rotation of the rotary body from the detection result of the rotational position detector.

Aspect 13.

In Aspect 13, an image forming apparatus (for example, the image forming apparatus 1) includes the sheet holder (for example, the bypass tray 72) according to any one of Aspect 1 through Aspect 11.

According to this configuration, an image forming apparatus including a sheet holder capable of accurately detecting the angle of rotation of the rotary body from the detection result of the rotational position detector.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet holder comprising:

a regulator to move in directions to approach an end portion of a sheet and to separate from the end portion of the sheet;

a rotary body including a contact portion, to rotate according to movement of the regulator;

a detection target, attached to the rotary body and including a contact target portion, to rotate together with the rotary body by contacting of the contact portion of the rotary body with the contact target portion of the detection target, in a rotational direction of the rotary body;

a rotational position detector to detect a rotational position of the detection target;

a biasing body to apply a biasing force between the rotary body and the detection target to maintain a contact state of the contact portion of the rotary body and the contact target portion of the detection target;

a rotary shaft provided to one of the rotary body and the detection target; and an engaging opening provided to another of the rotary body and the detection target, wherein one of the contact portion of the rotary body and the contact target portion of the detection target is provided on a circumferential surface of the rotary shaft, wherein another of the contact portion of the rotary body and the contact target portion of the detection target is provided on an inner wall surface of the engaging opening, and wherein the biasing body is attached inside the engaging opening.

2. The sheet holder according to claim 1, wherein the rotary shaft is a D-shaped shaft, wherein the one of the contact portion of the rotary body and the contact target portion of the detection target, provided on the circumferential surface of the rotary shaft, is a D-cut face of the D-shaped shaft, and wherein said another one of the contact portion of the rotary body and the contact target portion of the detection target, provided on the inner wall surface of the engaging opening, is an engaging surface to engage with the D-cut face.

3. The sheet holder according to claim 2, wherein the biasing body is configured to bias the engaging surface in a direction to separate one end side of the D-cut face, in a direction perpendicular to an axial direction of the rotary shaft of the rotary body, from the engaging surface.

4. The sheet holder according to claim 3, wherein the biasing body is a spring made of wire to apply the biasing force by resilience against deformation of the wire.

5. The sheet holder according to claim 4, wherein the spring includes one or more bent portions formed by bending the wire, and wherein the spring is configured to apply the biasing force by the resilience against deformation of the wire when the one or more bent portions are deformed in one of a closed direction and an open direction.

6. The sheet holder according to claim 5, wherein at least one of the one or more bent portions of the spring is inserted through the engaging opening and is retained in a position at which the at least one of the one or more bent portions is located outside the engaging opening in a direction of a surface perpendicular to the axial direction of the rotary shaft.

7. The sheet holder according to claim 6, wherein the spring is configured to take a shape in which the at least one of the one or more bent portions of the spring has passed the engaging opening at a timing of generating the biasing force of the spring when the spring is attached.

8. The sheet holder according to claim 1, further comprising a separation stopper to restrain separation of the biasing body attached to the engaging opening, from the engaging opening.

9. The sheet holder according to claim 1, wherein the biasing body includes a handle.

10. The sheet holder according to claim 9, wherein an outer shape of the handle is a circular shape.

11. A sheet feeding device comprising the sheet holder according to claim 1, to hold a sheet to be fed by the sheet feeding device.

12. An image forming apparatus comprising the sheet feeding device according to claim 11.

13. The sheet holder according to claim 1, wherein the biasing body is configured to apply the biasing force to a rotational direction between the rotary body and the detection target.

14. The sheet holder according to claim 1, wherein a spring functions as the biasing body, disposed between the rotary body and the detection target, to apply the biasing force to a rotational direction.

15. The sheet holder according to claim 14, wherein the spring is attached inside an engagement hole of the rotary body.

16. The sheet holder according to claim 1, wherein the biasing body is attached inside an engagement hole of the rotary body.

17. The sheet holder according to claim 13, wherein the biasing body is attached inside an engagement hole of the rotary body.

18. The sheet holder according to claim 1, wherein the biasing force is equal to or greater than a rotational torque of the rotary body.

19. The sheet holder according to claim 1, wherein the biasing force is set to be less than a damage allowable pressure of the rotary body.

* * * * *